US005107748A

United States Patent [19]

Muramatsu et al.

[11] Patent Number: 5,107,748

[45] Date of Patent: Apr. 28, 1992

[54] TOUCH-RESPONSE TONE CONTROLLER UNIT FOR AN ELECTRONIC MUSICAL INSTRUMENT

[75] Inventors: Shigeru Muramatsu; Keisuke Watanabe; Junichi Mishima, all of Hamamatsu, Japan

[73] Assignee: Yamaha Corporation, Hamamatsu, Japan

[21] Appl. No.: 479,932

[22] Filed: Feb. 14, 1990

[30] Foreign Application Priority Data

Feb. 16, 1989 [JP] Japan ..... 1-36882

[51] Int. Cl.[5] ..... G10H 1/055; G10H 1/18

[52] U.S. Cl. ..... 84/658; 84/688; 84/724; 84/725; 84/DIG. 7; 341/27; 341/31; 341/32; 356/356; 356/387

[58] Field of Search ..... 84/615, 626, 658, 687, 84/688, 689, 690, 724–729, DIG. 7; 356/356, 387; 364/130; 341/13, 27, 31, 32

[56] References Cited

U.S. PATENT DOCUMENTS 3,705,254 12/1972 Amano ..... 84/1.1
4,079,651 3/1978 Matsui ..... 84/1.1
4,131,365 12/1978 Pryor ..... 356/356
4,580,478 4/1986 Brosh et al. .
4,838,139 6/1989 Fiori, Jr. .
4,870,559 9/1989 Hyatt ..... 364/130
5,429,607 2/1984 Meno ..... 84/DIG. 7

FOREIGN PATENT DOCUMENTS 58-18812 2/1983 Japan .
60-152197 10/1985 Japan .
62-46498 3/1987 Japan .
62-187890 8/1987 Japan .

*Primary Examiner*—Stanley J. Witkowski
*Attorney, Agent, or Firm*—Spensley, Horn Jubas & Lubitz

[57] ABSTRACT

In construction of an electronic musical instrument having plural musical tone controllers such as keys, push buttons and an expression pedal unit, a number of pulses are generated depending on the extent of movement of each controller on output lines whose number is smaller than that of the pulses so generated and musical tone control parameters such as tone volume, tone color and tonal pitch are changed in multi-stage fashion in response to the pulses generated. Generation of musical tones is assured whilst well reflecting delicate change in player's emotion via subtle key touch control.

59 Claims, 27 Drawing Sheets

230
131
CK
CK1
132a
132b
132c
132d
133
FF
S
R
Q
Q̄
A>B
A<B
134
135a
135b
135c
135d
OS
137a
137b
137c
B-A
138a
138b
138c
C<A-B
139a
139b
139c
AND
N1
N2
N3
A
B
I
II
III
K
a
b
c
d

TOUCH-RESPONSE TONE CONTROLLER UNIT FOR AN ELECTRONIC MUSICAL INSTRUMENT

BACKGROUND OF THE INVENTION

The present invention relates to an electronic musical instrument, and more particularly relates to improvements in control of musical tone generation in response to controller operation on an electronic organ, an electronic piano or a portable electronic musical instrument, and the like.

In this specification, the term "a controller" refers to not only a white or black key but also a push botton key, a foot plate of an expression pedal mechanism, a knee lever, a joy stick operator on an electronic musical instrument. Further the term "musical tone control parameter" refers to all sorts of musical tone control parameters such as tone volume, tone colour, tonal pitch, tempo, depth and speed of vibrato and tremolo, etc.

Control of tone generation in an electronic musical instrument such an electronic organ is basically carried out by manual key operation which controls the state of an associated key switch. This mode of control, however, is too simple in tone generation characteristics to correctly reflect delicate changes in a player's feelings.

In an attempt to make up for this demerit in tone generation characteristics, it was already proposed to provide an electronic musical instrument with a so-called touch-response function which varies tone generation characteristics on the basis of the magnitude of key operation for richer reflection fo player's feelings. In accordance with this touch-response funcetion, the tone volume, the tonal pitch and the tone colour of a musical tone are controller in accordance with player's finger motion during the rise and decay periods of the musical tone.

In the case of a touch-response type control system proposed in U.S. Pat. No. 3,705,254, a relative displacement between a magnet and a coil is caused by key operation to generate a induced electromotive force output which is used to control the response to key touch. In this case, signal processing in analog mode requires a complicated hardware construction and, consequently, increased production cost. In addition, no stability in operation can be much expected.

Another touch-response type control system is disclosed in U.S. Pat. No. 4,079,651 in which an electrically conductive and elastic piece is deformed in response to key operation and such deformation establishes sequential short circuits between fixed contacts arranged on a substrate to change the resistance stepwise. Such change in resistance is converted into voltage output which is used to control the response to key touch. Also in this case singal processing is carried out in analog mode, which requires a complicated hardware construction and high production cost. In addition, it is rather infeasible to leave a too small pitch between adjacent fixed contacts from the view points of contact formation and circuit wiring. For these reasons, no subtle control of touch-response can be expected in the case of this prior proposal.

A further touch-response type control system is proposed in Japanese Patent Application Laid-Open Sho. 58-18812 in which a disc type mobile contact is driven for rotation by key operation. Following the rotation, the mobile contact is brought into sequential contact with a plurality of fixed contacts arranged on the substrate to generate digital signal outputs which are used for control of tone generation. This type of control system is well suite for an electronic musical instrument which generates musical tones by means of digital signal processing by a mirco computer recently in fashion. In this case also, subtleness in signal generation is much degraded by difficulty in contact arrangement. In addition, the number of output lines is directly affected by that of the contacts used in the system, thereby commplicating the construction and increasing the production cost.

SUMMARY OF THE INVENTION

It is the object of the present invention to provide an electronic musical instrument of a simple construction and low production cost which, nevertheless, assures subtle touch-response control of tone generation.

In accordance with the basic concept of the present invention, a number of pulses are generated corresponding to the extend of movement of a musical tone controller on output lines whose number is by far smaller than that of theh pulses and, in correspondence to the number of the pulses so generated, musical tone control parameters are chaned in a multistage fashion. The tone control parameters include tone volume, tone pitch, tone color, and various effects, further include touch feeling control and image control parameters, etc.

DESCRIPTION OF THE PREFERRED EMBODIMENTS

Figure 1:
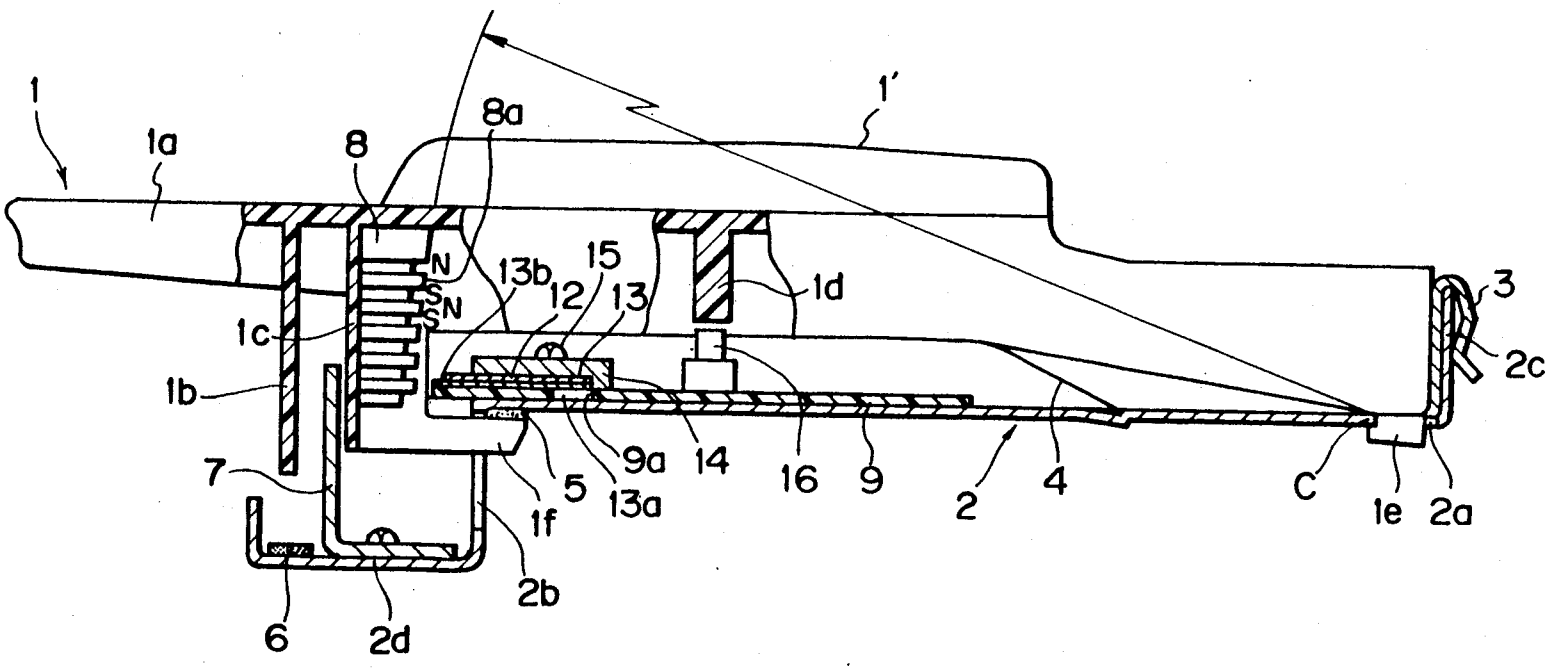
FIG. 1 is a sectional side view of the keyboard unit of the first embodiment of the electronic musical instrument in accordance with the present invention.
Figure 2:
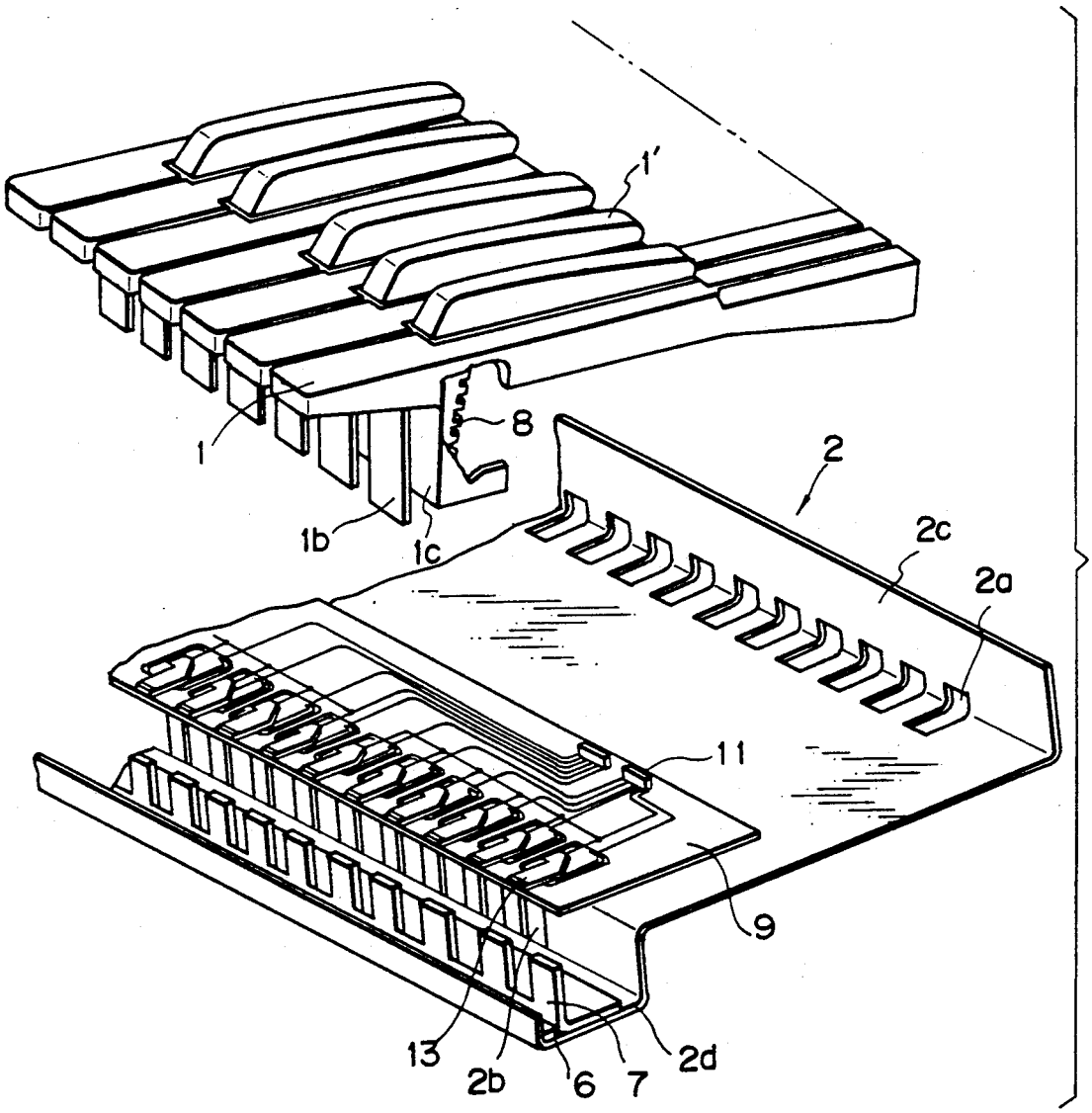
FIG. 2 is its perspective view in a disassembled state.

As stated above, the electronic musical instrument of the present invention is comprised of, as the major elements, means for genrating a number of pulses and means for changing musical tone control parameters.

The first embodiment of the electronic musical instrument in accordance with the present invention is shown in FIGS. 1 to 6 in which the instrument includes the first example of the pulse generating means. In the arrangement, a key 1 made of, for example, synthetic resin is provided with projecting sections 1*b* and 1*c* formed on the bottom face near its operating section 1*a*. An additional projecting section 1*d* is formed on the bottom face about the middle of its length. A engaging section 1*e* is formed on one end remote from the operating section 1*a*. The projecting section 1*c* is accompanied with a stopper section 1*f* for limiting the upward swing of the key 1.

Although a white key 1 is shown in the drawing, black key 1' is provided with a substantially same construction with an only exception that the operating section projects somewhat upwards.

The key 1 is supported by a frame 2 made of a magnetic material such as iron and its through holes 2*a* and 2*b* receive the engaging section 1*e* and the stopper section 1*f* of the key 1, respectively. A clip-type leaf spring 3 clamps a rear rise 2*c* of the frame 2 to allow pivotal movement of the key 1 about a support C on the frame 2, and the key 1 can't be separated from the frame 2.

Another leaf spring 4 is interposed between the key 1 and the frame 2 so as to bias the operating section 1*a* of the key 1 upwards. The extent of the upward bias of the operating section is limited by contact of the stopper section 1*f* of the key 1 with a stopper 5 attached to the bottom face of the frame 2. The stopper 5 is generally made of felt.

A lower step 2*d* formed at the front end of the frame 2 carries a stopper 6 for contact with the projecting section 1*f* of the key at key operation. This stopper 6 is also generally made of felt. Near the stopper 6, the lower step 2*d* further carries a rise 7 made of a magnetic material such as iron facing each key 1. The rise 7 is screw fixed to each projecting section 1*c* of the key 1 whilst leaving a small gap in between to form a common rear yoke.

The projecting section 1*c* is accompanied on its rear face with a laminated magnet 8. This laminated magnet 8 is made up of a plurality of unit magnets superimposed with each other, alternating the positioning of their N and S poles. The laminated magnet 8 is attached to the projecting section 1*c* at its one magnetic pole face and the other pole face 8*a* extends along a plane defined by an imaginary arc having its center on the support C on the frame 2. More specifically, its N poles project from the plane and its S poles recede from the plane.

The above-described contruction forms means for inducing magnetic change.

Figure 3:
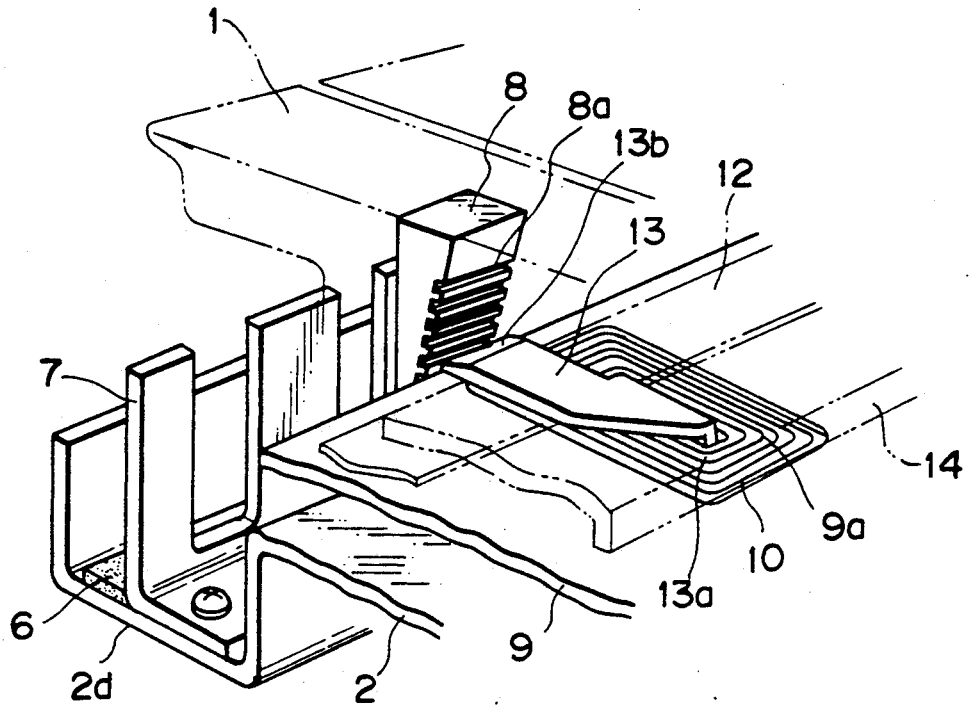
FIG. 3 is an enlarged perspective view of its main part.

As shown in FIG. 3, a print board 9 is mounted to the top face of the frame 2 and is provided with slits 9*a* which extend in the longitudinal direction of the key 1 in parallel to each other at a pitch equal to that between adjacent keys 1. A coil 10 is formed surrounding each slit 9*a* by means of printing process. One end of the printed coils 10 in a same octave are grouped for common connection to a connecting terminal 11 whereas the other end of the coils 10 in a same octave are also grouped and earthed together.

Figure 4:
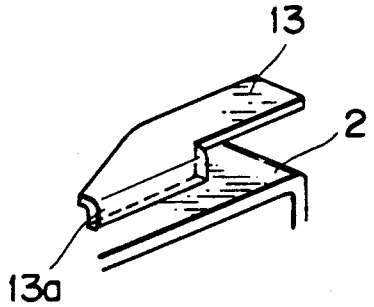
FIGS. 4 and 5 are perspective views of different embodiments of its yoke and frame.

An iron yoke 13 is placed on the print board 9 via an adhesive insulating sheet 12 and its bent section 13*a* is brought into contact with the top face of the frame 2 whilst passing through the associated slit 9*a* (See FIG. 4). The other end of the yoke 13 faces the pole face 8*a* of the laminated magnet 8 with a slight gap in between. In this arrangement, a cover 14 made of a non-magnetic material is fixed to the yoke 13 via a screw 15 (in FIG. 1) in order to fix the position of the yoke 13 and to press its bent section 13*a* against the frame 2.

Figure 5:
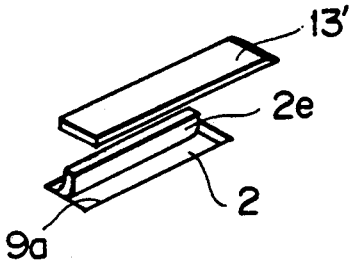

The above-described construction forms means for detecting magnetic change. A slope 13*b* is preferably made at the other end of the yoke 13 for reduced magnetic flux loss. As a substitute for the pressure contact of the bent section 13*a* with the frame 2, a flat yoke 13' such as shown in FIG. 5 may be used in combination with the frame 2 having a bent section 2*e* for tight contact with the yoke 13'. A penetrating photosensor 16 may be arranged on the print board 9 facing the projecting section 1*d* of the key 1 so that the projecting section 1*d* should intercept a beam issued by the photosensor 16 for detection of the state of the key 1.

The above-described first embodiment of the present invention operates as follows. In FIGS. 1 and 3, a closed magnetic circuit is formed by the laminated magnet 8 including the yoke 13, the frame 2 and the rise 7. When the operating section 1*a* of the key 1 is depressed against repulsion by the leaf spring 4, the laminated magnet 8 moves downwards along an arc having its center on the support C. During this movement, the direction of line of magnetic force is reversed when the N or S pole of the magnet 8 mates the yoke 13, thereby causing abrupt changes in magnetic flux in the above-described closed magnetic circuit. As a result, induced current in pulse mode flows through the coil 10 formed around the yoke 13 in alternate directions and a number of pulses are generated in non-contact mode in correspondence to the extent of movement of the key 1, the controller. The number of the pulses generated within a unit time is proportional to the depression speed of the key 1. So, by changing the above-described musical tone control parameters in multistage fashion, musical tones can be generated exactly as intended by the player while subtly reflecting delicate changes in player's feelings.

For issue of the pulse signals by the above-described arrangement, it is needed to prepare one common earth line for all the keys and one signal line for each key only.

Figure 6A:
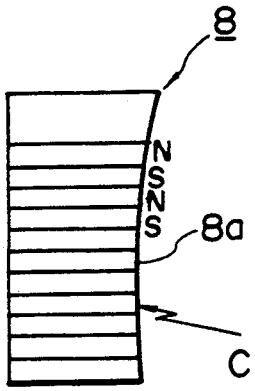
FIGS. 6A to 6D are explanatory views of various embodiments of its laminated magnet.
Figure 6B:
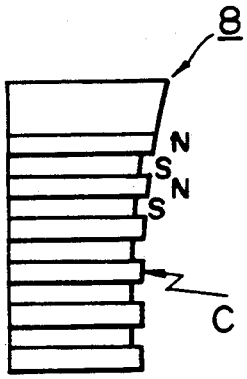
Figure 6C:
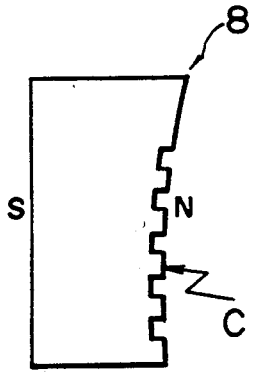

Various examples of the laminated magnet 8 are shown in FIGS. 6A to 6D. In the case of the laminated magnet 8 shown in FIG. 6A, its pole face 8*a* is defined by an arc having its center on the support C on the frame 2 and the N and S poles are superimposed up and down. With this arrangement, the induced current appearing on the coil 10 varies softly. The N and S poles of this type can be formed by magnetization of even a micron order pitch. In the arrangement shown in FIG. 6B, the N poles project from the arc plane and the S poles recede from the arc plane. Since the induced current appearing on the coil 10 in this case includes sharp rises and falls, this arrangement is quite suited for generation of high peak pulses. The magnet 8 shown in FIG. 6C is same in configuration as the one shown in FIG. 6B but its N (or S) pole is positioned on the yoke side face and its S (or N) pole is positioned on the opposite face. In the case of these three examples, same pulses are generated during the go- and return-movement of the key 1. As a consequence, when it is required to utilize the pulse generated during the go-movement only, some additional means must be provided to discriminate the direction of the key movement or some complicated signal processing must be employed. This inconvenience can be tactfully obviated in the case of the arrangement shown in FIG. 6D in which the pole face of the magnet 8 has a saw tooth configuration. When the key is depressed with this arrangement, its positive rise pulse is made large and its negative rise pulse is made small. Whereas, when the key returns from the depression, its positive rise pulse is made small and its negative rise pulse is made large. As a consequence, by setting a threshold level higher than the positive rise pulse during return from depression, only the pulses generated during key depression can be easily selected.

Figure 7:
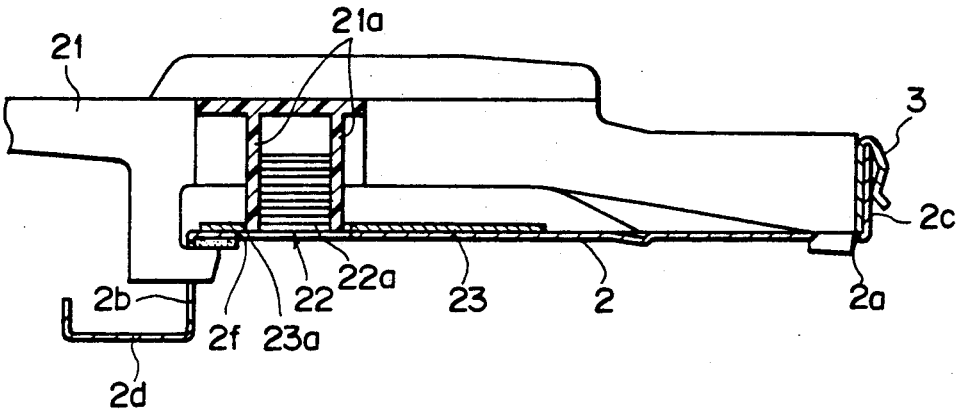
FIG. 7 is a sectional side view of the keyboard unit of the second embodiment of the electronic musical instrument in accordance with the present invention.
Figure 8:
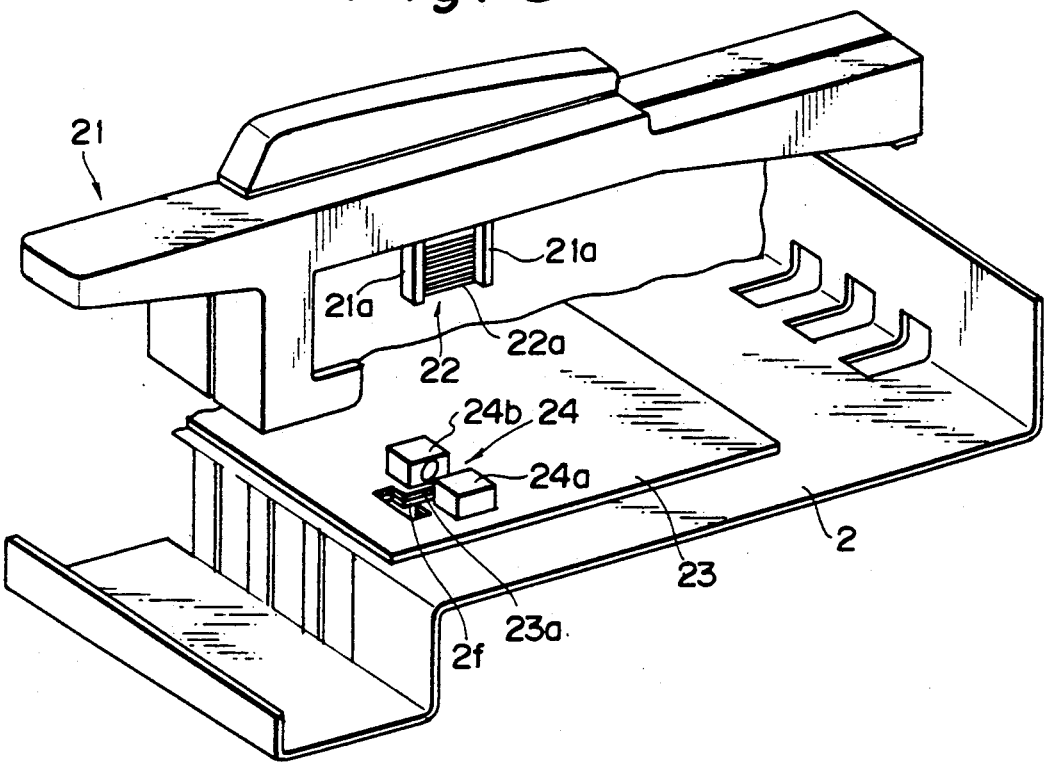
FIG. 8 is its perspective view in a disassembled state.
Figure 9:
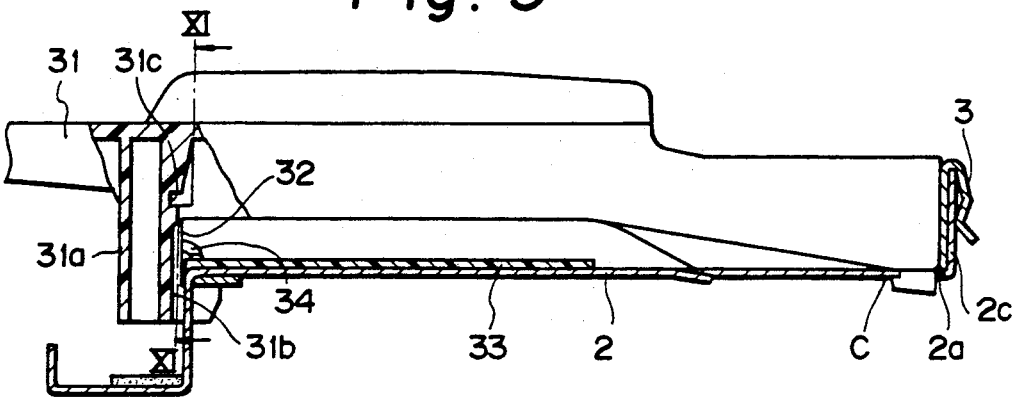
FIG. 9 is a sectional side view of the keyboard unit of the third embodiment of the electronic musical instrument in accordance with the present invention.
Figure 10:
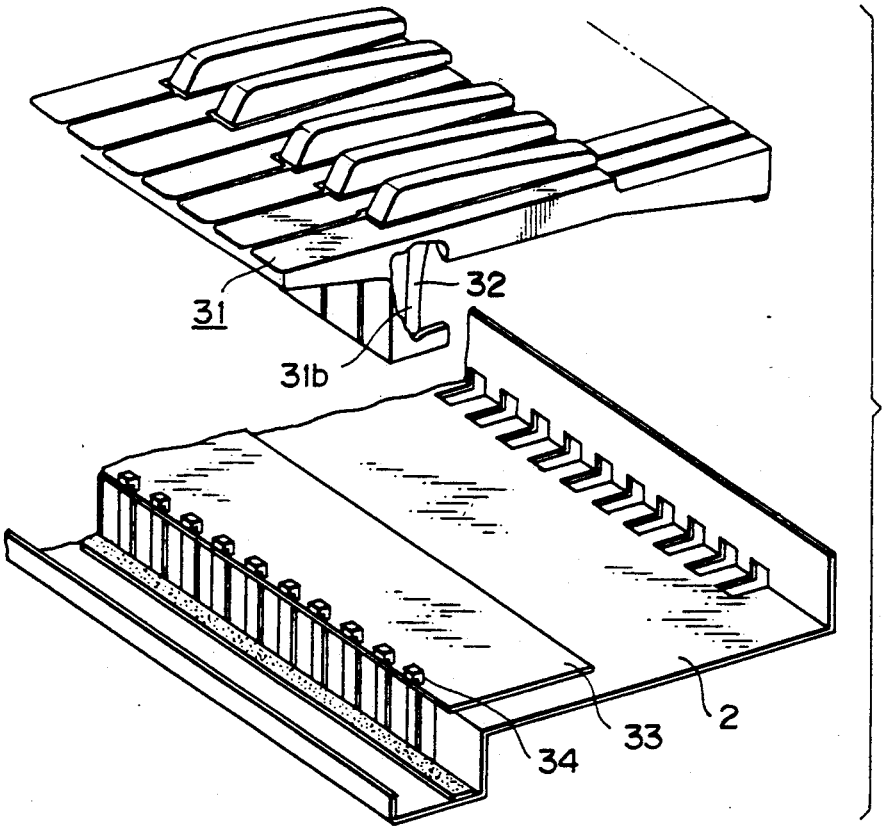
FIG. 10 is its perspective view a disassembled state.

The second embodiment of the electronic musical instrument in accordance with the present invention is shown in FIGS. 7 and 8 in which pulses are generated in a photoelectric manner. In the case of this embodiment, supporting webs 21*a* are formed on the bottom face of a key 21 whilst projecting downwards and a pattern plate 22 is mounted to the supporting webs 21*a* whilst extending in the longitudinal direction of the key 1. As shown in FIG. 8, the pattern plate 22 includes opaque horizontal stripe patterns 22*a* formed on a transparent film at fine intervals. These elements form optical change inducing means.

A print board 23 is arranged on the frame 2 facing the bottom face of the key 21 and slit 2*f* for the supporting webs 21*a* and a slit 23*a* for the pattern plate 22 are formed through the print board 23 and the frame 2. These slits 2*f* and 23*a* are connected to each other to form an H-shaped continuous opening. A light emitter 24*a* and a light collector 24*b* are arranged sandwiching the slit 23*a* for the pattern plate 22 to form a penetrating type photosensor 24. These elements form means for detecting optical change.

As the key 21 is depressed, the pattern plate 22 passes through the gap between the light emitter 24*a* and the light receiver 24*b* so that the light beam between them is temporarily intercepted by the horizontal patterns 22*a* and such interception causes a change in pulse mode of the current flowing in the light receiver 24*b*. Thus a nunber of pulses are generated in non-contact fashion in correspondence to the extent of movement of the key 21.

Figure 11:
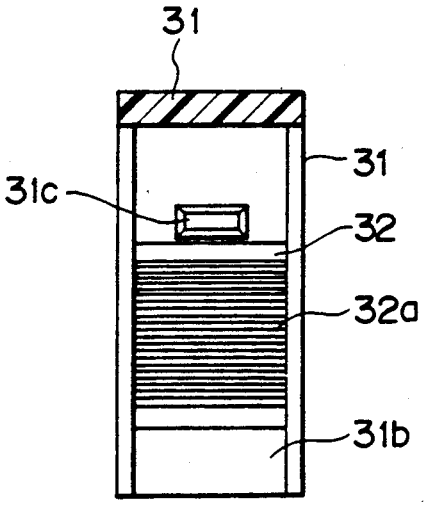
FIG. 11 is a secontion taken along a line XI—XI in FIG. 9, FIGS. 12A to 12C are explanatory views of its reflection type photosensor.

The third embodiment of the electronic musical instrument in accordance with the present invention is shown in FIGS. 9 to 12 in which pulses are again generated in a photoelectric manner. A cavitious projection 31*a* is formed on the bottom face of a key 31 to operate as a stopper for movement of the key 31. The rear face 31*b* of the projection 31*a* is defined by an imaginary circle having its center of the support C. A pattern plate 32 including horizontal stripe patterns at fine intervals as shown in FIG. 11 is bonded to the rear face 31*b* of the projection 31*a* to provide a pattern face 32*a*. Alternatively, horizontal patterns may be directly applied to the rear face 31*b* of the projection. These elements form the optical change inducing means. Facing the pattern face 32*a* on the key 31, a reflecting type photosensor 34 is arranged on a print board 33 mounted to the top face of the frame in order to form the optical change detecting means.

Figure 12A:
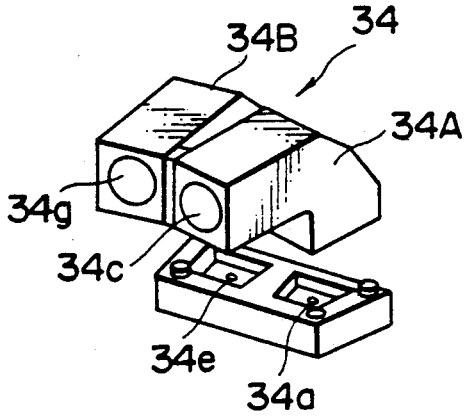
Figure 12B:
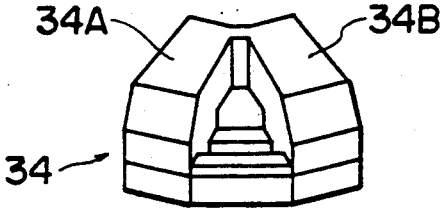
Figure 12C:
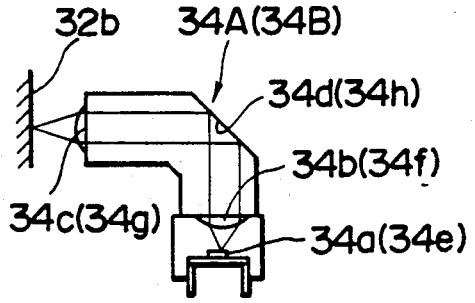
Figure 13:
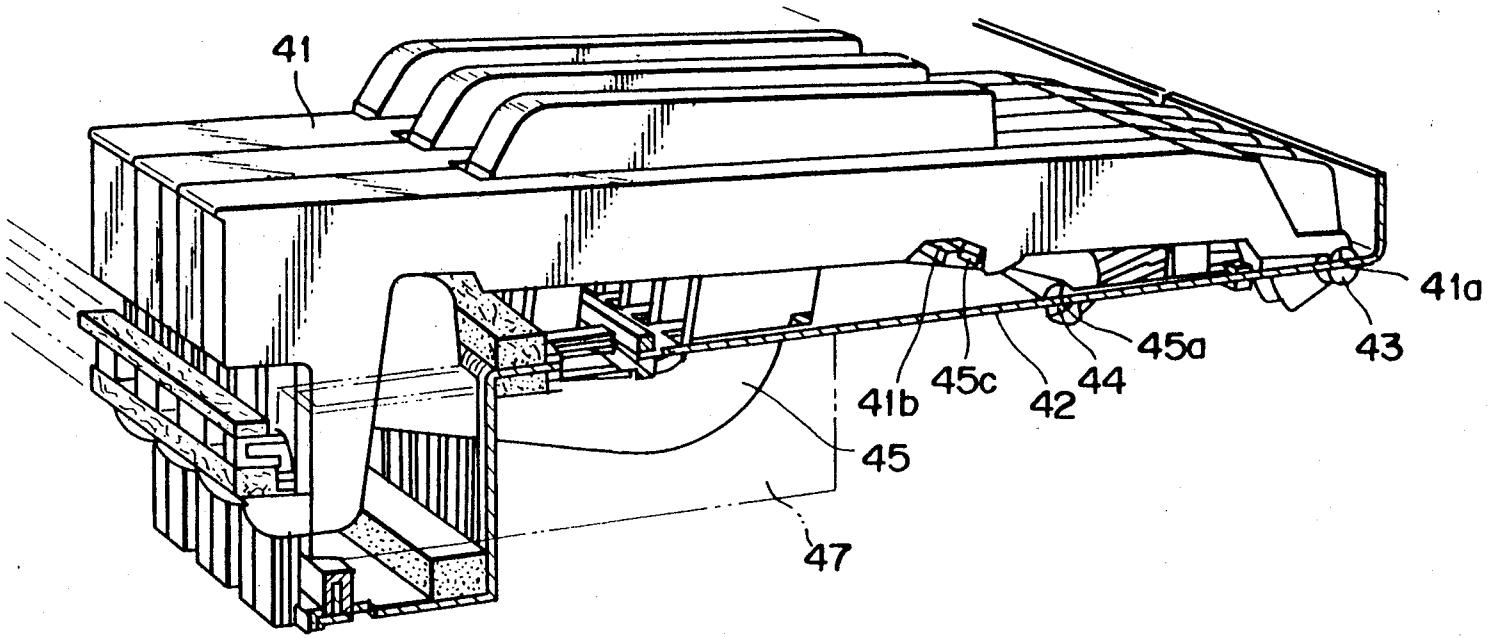
FIG. 13 is a perspective view of the keyboard unit of the fourth embodiment of the electronic musical instrument in accordance with the present invention.
Figure 14:
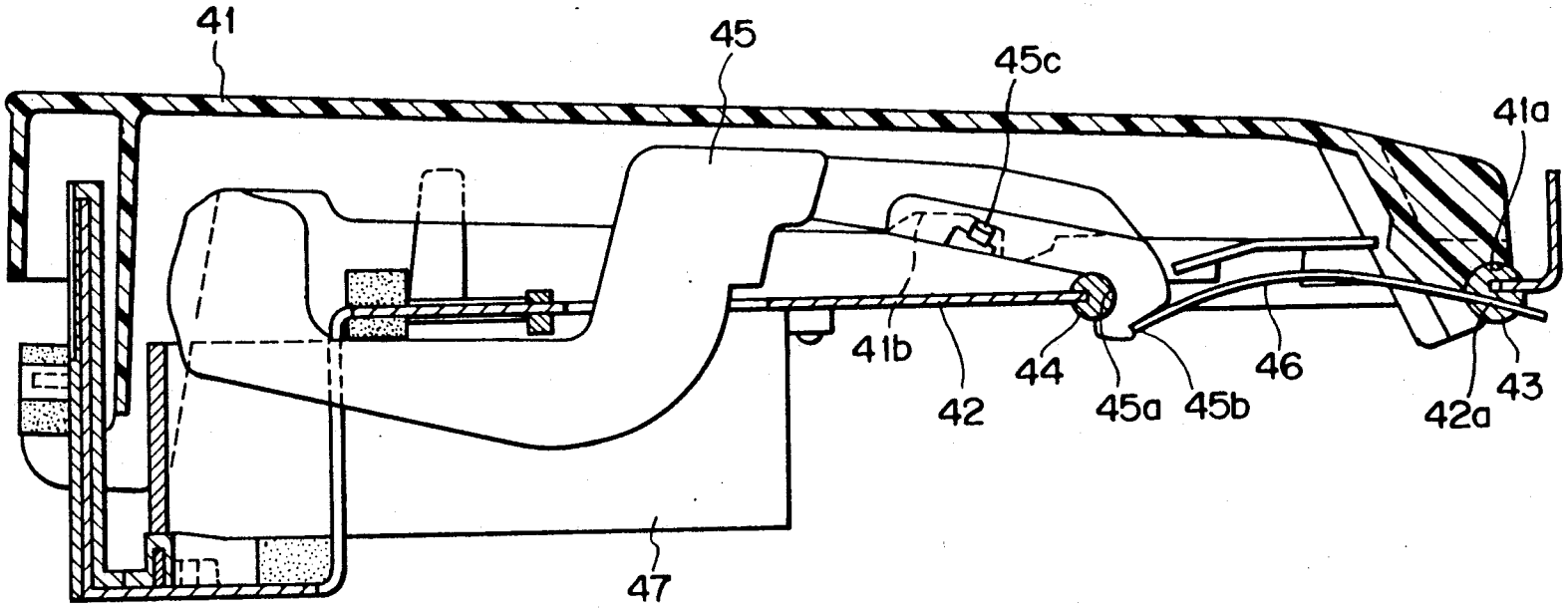
FIG. 14 is its sectional side view.

One example of the reflecting type photosensor 34 is shown in detail in FIGS. 12A to 12C. The photosensor 34 is made up of a light emitter 34A and a light collector 34B. The light emitter 34A includes a light emitting element 34*a* such as a light emitting diode, a pair of condenser lenses 34*b* and 34*c* and a reflecting plane 34*d*. Whereas the light collector 34B includes a light collecting element 34*e* such as a photodiode or a phototransistor, a light collecting lens 34*f* and a reflecting plane 34*h*.

Light beams issued by the light emitter 34A are made parallel to each other by the condenser lens 34*b* and, after changing their course of travel over 90 degrees at the reflecting plane 34*d*, are collected onto the pattern face 32*a* by operation of the condenser lens 34*c*. Light beams reflected at the pattern face 32*a* are made parallel to each other after passage through the collecting lens 34*g* and, after changing their course of travel over 90 degrees at the reflecting plane 34*h*, are collected onto the collecting element 34*e* by operation of the collecting lens 34*f*.

As the pattern face 32*a* swings downwards on depression of the key 31, the light collector 34B intermittently collects light from the light emitter 34A to practice photoelectric conversion, thereby generating a number of electric pulses in correspondence with changes in intensity of the light so collected.

Here, the cavity 31*c* in the projection 31*a* is a sort of asylum for the photosensor 34 which allows smooth rearward sliding of the key 31 at mounting to the frame 2.

The fourth embodiment of the electronic musical instrument in accordance with the present invention is shown in FIGS. 13 to 24 in which key movement is mechanically amplified in order to provide the so-called piano tough even on an electronic musical instrument. A key 41 is provided at the proximal end with a recess 41*a* which is in pivotal engagement with a pin 43 fixed to the rear end of a slit 42*a* formed in a frame 42. Another pin 44 is fixed to the front end of the slit 42*a* in pivotal engagement with a recess 45*a* formed in the proximal end of a hammer 45 made of a massy material such as iron. This hammer 45 is driven for an amplified movement when the key 41 is operated. A leaf spring 46 is fixed at its proximal end to the pin 43 and its free distal end is placed in engagement with a rear step 45*b* formed on the hammer 45. By this spring force the hammer 45 is urged to turn clockwise in FIG. 14.

The hammer 45 is provided with a presser 45*c* for engagement with a recess 45*b* formed in the bottom face of the key 41 so that the hammer 45 should move downwards against repulsion by the leaf spring 46 when the key is depressed. There is a big difference between the distance of the presser 45*c* from the pin 43 for the key 41 and the distance of the presser 45*c* from the pin 44 for the hammer 45. More specifically, the distance of the presser 45*c* from the hammer pin 44 is smaller than that of the presser 45*c* from the key pin 43. As a consequence, movement of the key 41 is greatly amplified due to this difference in distance to cause a corresponding movement of the hammer 45. Thus, the so-called piano touch is obtained by this amplification even on an electronic musical instrument.

Figure 15B:
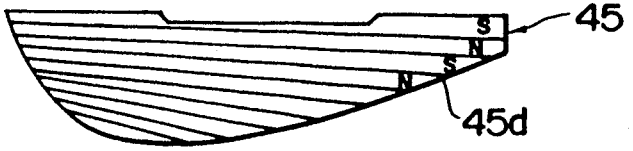
FIG. 15A and 15B are explanatory views of the manget pattern formed on its hammer.
Figure 15E:
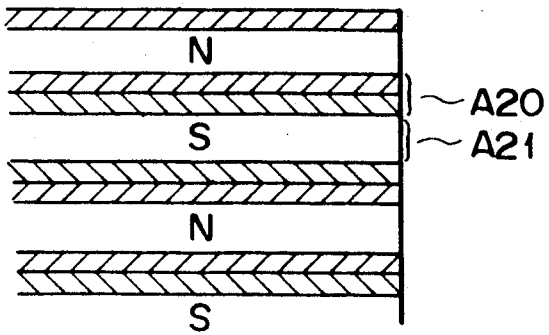
FIG. 15E is a sectional side view of the mode of magnetization on the arrangement shown in FIGS. 13 and 14.
Figure 15A:
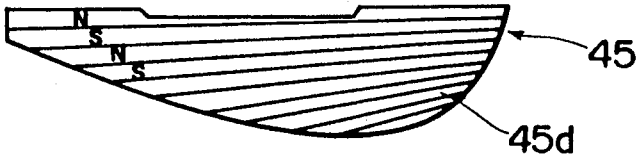
Figure 16:
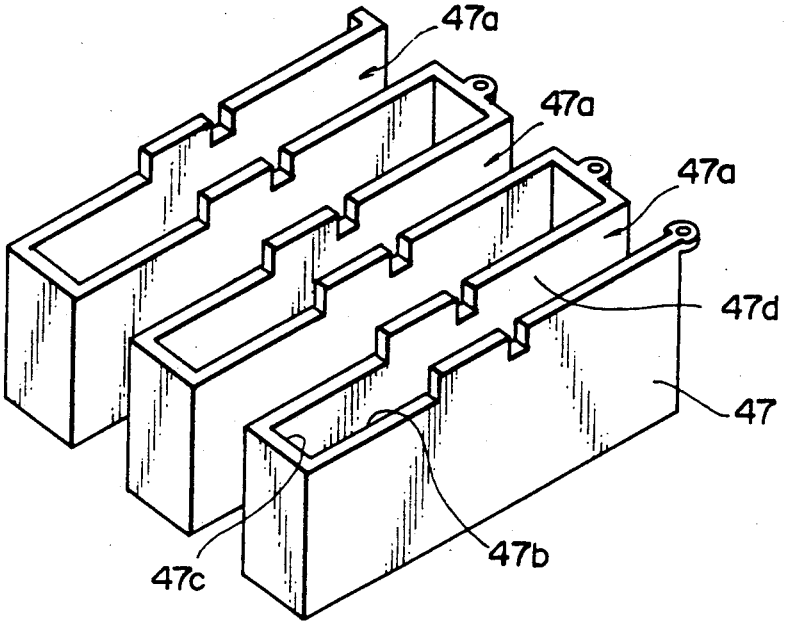
FIG. 16 is a perspective view of its frame.

The hammer 45 is provided on its lower side face with a magnet pattern 45*d* such as shown in FIG. 15A. This magnet pattern 45*d* includes a plurality of N- and S-poles which are magnetized at alternate positions in an imaginary sector having its center on the hammer pin 44. A resin block 47 such as shown in FIG. 16 is fixed to the bottom face of the frame 42 having juxtaposed narrow interstices 47*a* so that the magnet pattern 45*d* of each hammer 45, i.e. each key 41, should be idly received in an associated interstice 47*a*.

Figure 17:
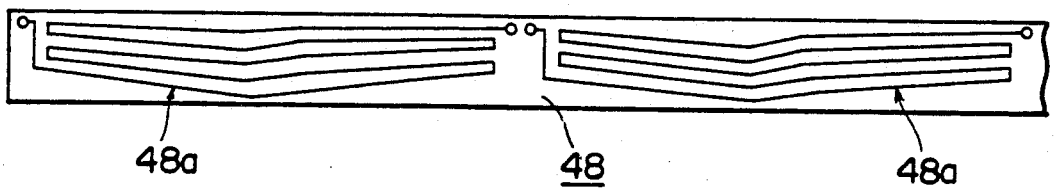
FIG. 17 is an extended view of its flexible substrate.
Figure 18:
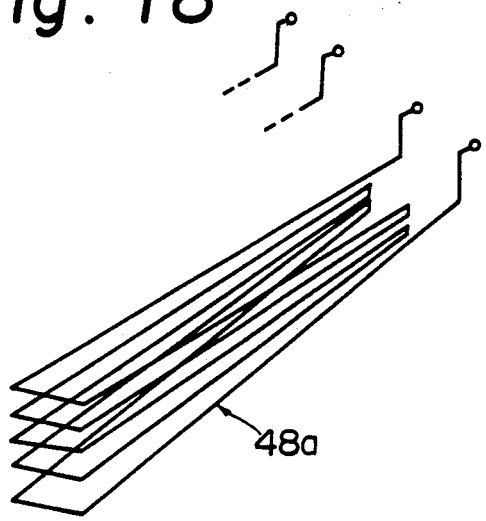
FIG. 18 is a perspective view of the conduction pattern formed on its flexible substrate.

At moulding of the resin block 47 a flexible substrate 48 including a plurality of conductive patterns 48*a* such as shown in FIG. 17 is placed in a mould with the conductive patterns 48*a* being folded as shown in FIG. 18 before injection of resin. The conductive patterns 48*a* are arranged on walls 47*b* to 47*d* of the molded resin block 47 surrounding the interstices 47*a*. In this case, the conductive pattern 48*a* between the walls 47*b* and 47*d* should be arranged so as to meet the radial direction from the pin 44 on the frame 42.

Figure 19:
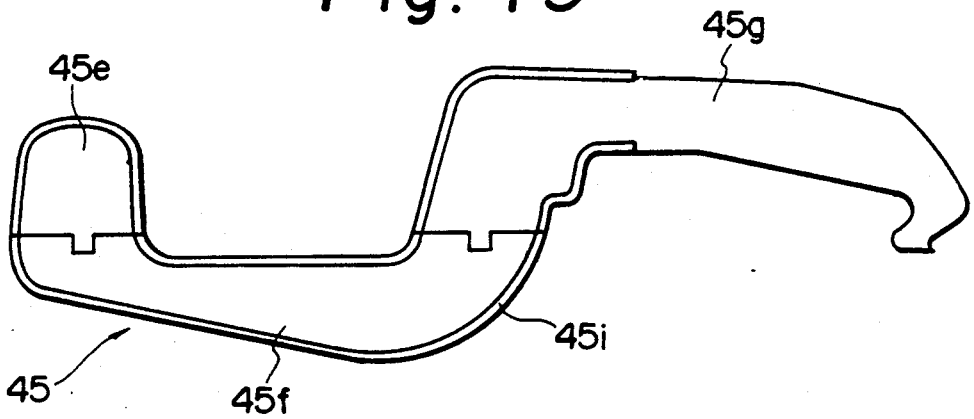
FIG. 19 is a front view of its hammer in the complete form, 20 is a perspective view of the hammer in an incomplete form.
Figure 20:
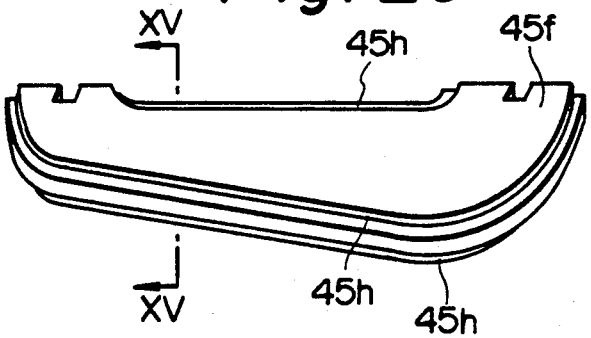

Briefly speaking, the hammer 45 is prepared as follows. In the first place a distal piece 45*e*, a middle piece 45*f* and a proximal piece 45*g* made of iron are prepared. Except for faces for bonding, cutouts 45*h* are formed on the edges of, for example as shown in FIG. 20, the middle piece 45*f*. After magnetization of the both faces of the middle piece 45*f*, the cutouts 45*h* are covered with resin films 45*i*. The distal and proximal pieces 45*e* and 45*g* are prepared in a same manner and they are combined together to form a monolithic hammer 45 as shown in FIG. 19. Addition of such resin films prevents undesirable contact of rough edges of the hammer 45 with the inner faces of the resin block 47. Here, the thinner the resin films, the larger the magnetic change. The better way recommended is to smooth the edges of the hammer 45 without covering with such resin films.

Figure 21:
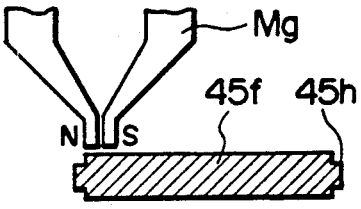
FIG. 21 is an explanatory view of the magnetization process of the magnet pattern.

A strong electromagnet such as shown in FIG. 21 is used for magnetization of the middle piece 45*f* of the hammer 45. Partial magnetization of one face is carried out during relative intermittent movement between the electromagnet and the middle piece 45*f* at prescribed intervals. After complete magnetization of one face, the other face is magnetized in same manner. For stronger magnetization, it is preferable to magnetize the other face in a reversed order of poles as shown in FIG. 15B. In this way, the conductive patterns 48*a* on the walls 47*b* and 47*d* are phased from each other by a distance equal to one pitch of the magnet pattern 45*d* formed on the hammer 45. Both faces of the middle piece 45*f* may be magnetized concurrently too.

As the key swings downwards about the pin 43 at key depression, the hammer 45 also swings downwards about the pin 44 at a speed faster than the key 41 and its magnet pattern 45 passes by the region of the conductive pattern 48*a* on the resin block 47 and corresponding current flows through the conductive pattern 48*a*.

Figure 22:
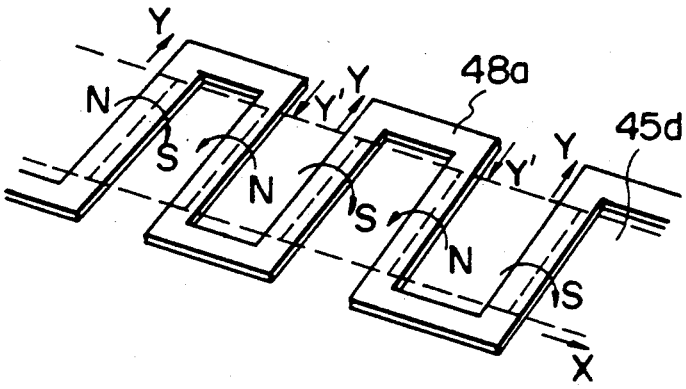
FIG. 22 is a perspective view of the conduction pattern and the magnet pattern for showing the principle of pulse generation with the arrangement shown in FIG. 13.

The principle of this electric conduction will be explained in reference to FIG. 22. With the illustrated arrangement of the magnetic pattern 45*d*, the current flows through the conductive pattern 48*a* in the direction of an arrow Y or Y'. As the magnet pattern 45*d* moves in the direction of an arrow X over one pitch, the direction of the magnetic field is reversed and the flowing direction of the current is also reversed. This change in flowing direction of the current produced pulses of opposite polarities. The conductive pattern 48*a* is continously folded in a hairpin mode at sections extending normal to the moving directions of the magnet pattern 45*d* in order to provide a long pattern within a limited space, thereby generating large pulses.

When the length of the conductive pattern 48*a* is equal to $\iota$, the moving speed of the magnet pattern 48*a* is equal to v and the magnetic flux density is equal to B, the induced electromotive force (E) is given by the following equation;

$$E = vB\iota$$

It is clear from this equation that increase in length of the conductive pattern 48*a* brings about enlarged electromotive force.

Figure 15C:
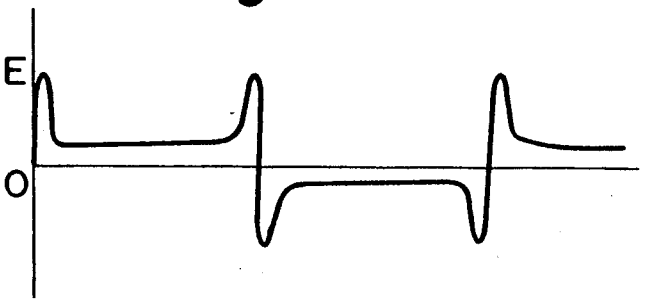
FIGS. 15C and 15D are graphs for showing the mode of pulse generation on the arrangement shown in FIGS. 13 and 14.

One example of the pulse signal so generated is shown in FIG. 15C. This pattern of pulse signal is resulted from the fact that, as shown in FIG. 15E, highly magnetized sections A20 exist at the borders between N- and S-poles and lowly magnetized sections A21 are made between the borders naturally. By properly adjusting the mode of magnetization, a sine wave pulse signal can be obtained too.

It should be noted that the pulse generating means of this embodiment can be used in a keyboard type electronic musical instrument without hammer too by arranging the magnet pattern the side face of a member attached to a key.

In the case of the above-described embodiment, the number of pulses generated is in inverse proportion to the pitch of the magnet pattern 45*d* formed on the hammer 45. In other words, the smaller the pitch of the magnet pattern, the larger the number of the pulses. From the view point of magnetic flux density, however, its sometimes difficult to employ a too small pitch in design of the magnet pattern 45*d*. This conflicting problem can be solved by properly adjusting the pattern of the conductive pattern 48*a*.

Figure 15D:
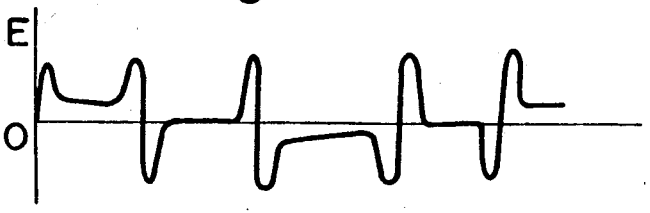
Figure 23:
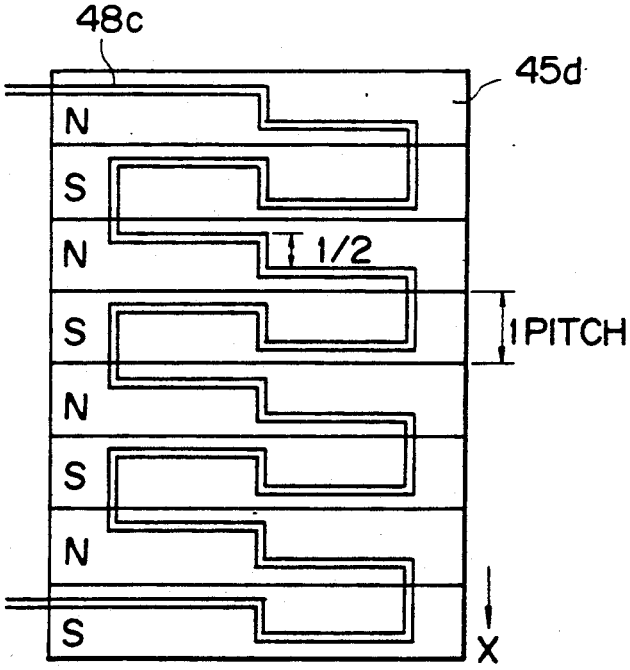
FIG. 23 is an explanatory view of a different embodiment of the conduction pattern.
Figure 24:
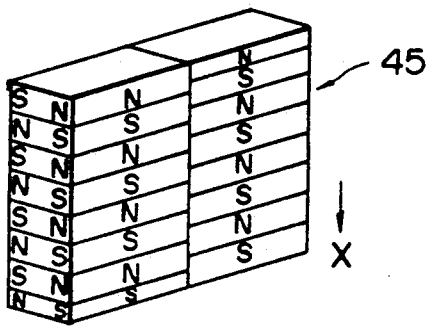
FIG. 24 is an explanatory view of a different embodiment of the magnet pattern formed on the hammer.

One example of such a conductive pattern is shown in FIG. 23. On one side of the conductive pattern 48*c*, the pitch of the pattern is phased in the central section over ½ of the pitch of the magnet pattern 45*d*. By phasing the pattern over ½ pitch in the direction of an arrow X in FIG. 23, the change in pitch of the magnetic field is made one-half in the section extending normal to the arrow X so that a double number of pulses should be generated per same extent of movement of the magnet pattern 45*d* as shown in FIG. 15D. As an alternative, the magnet pattern on the hammer 45 may be phased in the central section over ½ of the pitch of the conductive pattern in the direction of the arrow X in FIG. 24.

Figure 25:
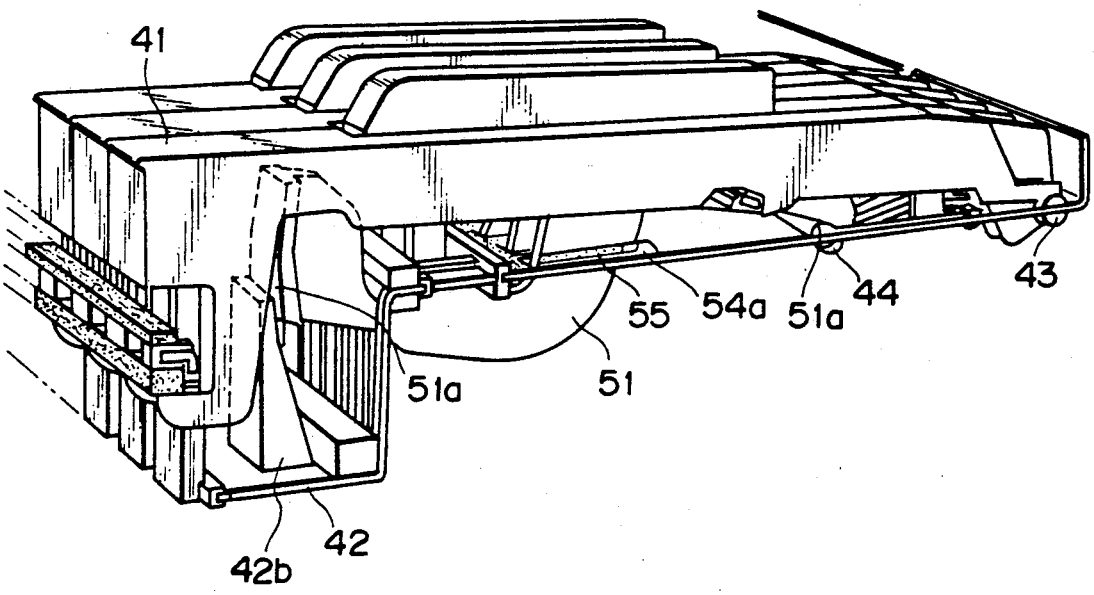
FIG. 25 is a perspective view of the keyboard unit of the fifth embodiment of the electronic musical instrument in accordance with the present invention.

The fifth embodiment of the electronic musical instrument in accordance with the present invention is shown in FIGS. 25 to 29 in which pulses are generated in a photoelectric manner in response to movement of a hammer. In FIG. 25, a hammer 51 is mounted to the frame 42 in a manner substantially same as the hammer 45 in the foregoing embodiment. A convex arc face 51*a* is formed at the distal end of the hammer 51 with its center falling on the pin 44 for the hammer and a pattern place 52 is bonded to the arc faces 51*a*. This pattern plate 52 is provided with a horizontal stripe pattern 52*a* such as shown in FIG. 26A to form a pattern face 52*b*. As an alternative, the stripe pattern 52*a* may be applied directly to the arc face 51*a* too.

Figure 26A:
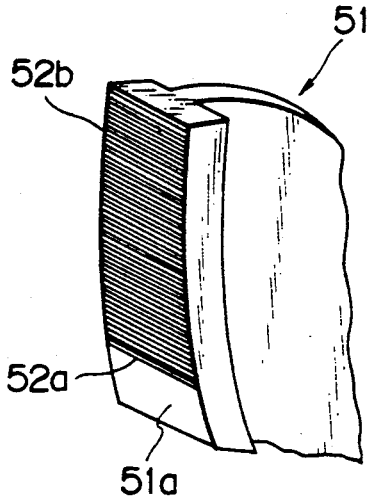
FIG. 26A and 26B are a perspective views of its main parts.
Figure 26B:
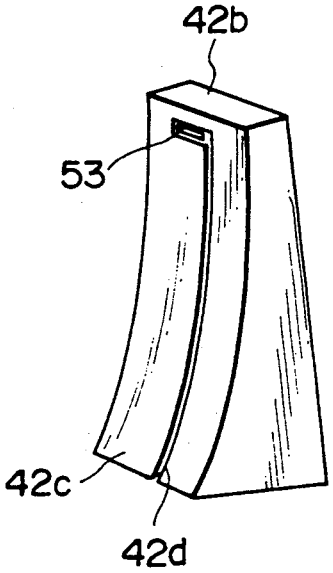
Figure 27:
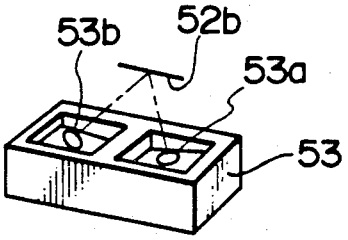
FIG. 27 is a perspective view of a reflection type photosensor arranged facing its pattern face.

A stand 42*b* having a concave arc face 42*c* is mounted to the frame 42 whilst facing the pattern face with a slight gap and a reflecting type photosensor 53 is arranged on the arc face 42*c* as shown in FIG. 26B. This photosensor 53 is made up of a light emitting element 53*a* and a light collecting element 53*b* as shown in FIG. 27 and connected to a power source not shown by means of a conductor running through a slit 42*d* formed in the arc face 42*c* so that light beams issued by the light emitting element 53*a* is reflected at the pattern face 52*b* to reach the light collecting element 53*b*.

With this arrangement, as the key 51 swings downwards, the pattern face 52*b* also swings downwards about the pin 44. The light collecting element 53*b* then collects light from the pattern face 52*b* intermittently so as to generate a number of pulses after photoelectric conversion of the light.

Figure 28:
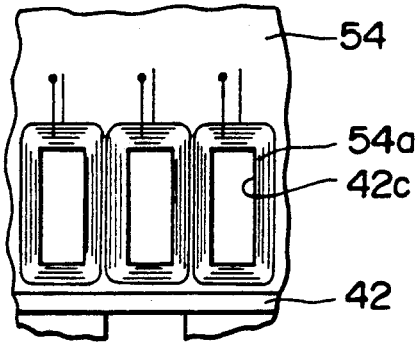
FIG. 28 is a front view of a part of a printed substrate used in this embodiment.

Further in FIG. 28, a slit 42*c* for passage of the hammer 51 is formed in a print board 54 bonded to the frame 42 and the slit 42*c* is surrounded by a coil 54*a*. As shown in FIG. 25, a magnet pattern 55 is provided at a position just before the upper limit of the hammer movement where the hammer 51 passes by the coil 54. With this arrangement, a pulse signal can be generated by the coil 54*a* just before complete return of the key 41 to its initial position.

Further, magnetic patterns same as the one 45*d* shown in FIG. 15A are applied to both sides of the hammers 51 part passing through the slit 42*c* over the entire stroke of the hammer movement. In this case, movement of the hammer 51 caused by key depression generates AC current in the coil 54*a* which can be used to energize the photosensor 53 after proper rectification. In this way, photoelectric pulse generation can be carried out without any power supply from outside the system.

Figure 29:
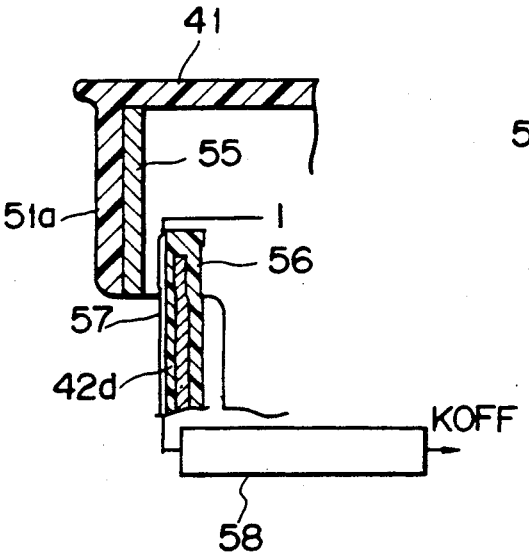
FIG. 29 is a sectional view of the main part of an arrangement for generating key-off signals.

In FIG. 29, a metallic plate 55 made of iron or aluminum is bonded to the inner wall of the front end 51*a* of the key 41 and a print board 56 is fixed to front rise of the frame 42. A coil 57 is printed on the print board 56 facing the metallic plate 55. With this arrangement, movement of the metallic plate 55 on key depression causes a change in magnetic flux, thereby causing a corresponding change in current flowing through the coil 57. The coil 57 is connected to a detection circuit 58 which detects such a change in current that is, key-on state and key-off state can be distinguished and issues a key off signal KOFF during return movement of the key 41.

Figure 30:
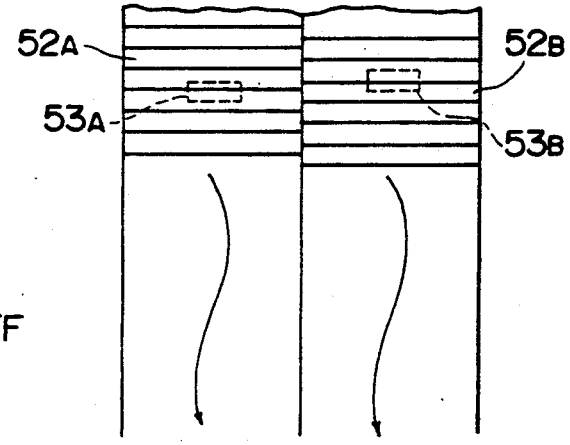
FIG. 30 is a stripe pattern diagram for discriminating the direction of movement of the hammer and the key.
Figure 31A:
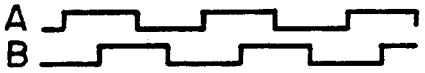
FIGS. 31A and 31B are wave diagrams of pulse signals detected by the pattern during the movements shown in FIG. 30.
Figure 31B:
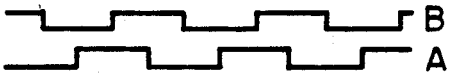

In the case of this embodiment without such system as FIG. 29 described above, same signals are generated from the photosensor 53 during the go- and return-movement of the key, which cannot be discriminated. A solution to this problem is shown in FIG. 30 in which the stripe pattern formed on the arc face of the hammer 51 is made up of a pair of patterns 52A and 52B which are phased from each other by ½ pitch and a pair of photosensors 53A and 53B are arranged at a same level in both of the patterns 52A and 52B. With this arrangement, the outputs from the photosensors 52A and 52B during the go-movement of the hammer 51 are shown in FIG. 31A. In this case, the output A is ahead of the output B by a phase equal to $\pi/2$. The outputs during the return-movement of the hammer 51 are shown in FIG. 31B in which the output B is ahead of the output A by a phase equal to $\pi/2$. The direction of the movement of the hammer 51 is discriminated on the basis of such a mode of phase lag. As a substitute for the phase in horizontal stripe, the pair of photosensors 52A and 52B may be phased by half of the pattern pitch.

It should be noted that this solution is applicable to the first to fourth embodiments also. When the pulse generating means includes a magnet, a coil and a yoke, the magnet pattern may be divided into a pair of patterns of ½ phase lag and a pair of yokes each with the coil may be arranged in combination with such a pair of divided magnet patterns. In an alternative, a pair of yokes may be arranged with ½ pitch phase lag.

Figure 32:
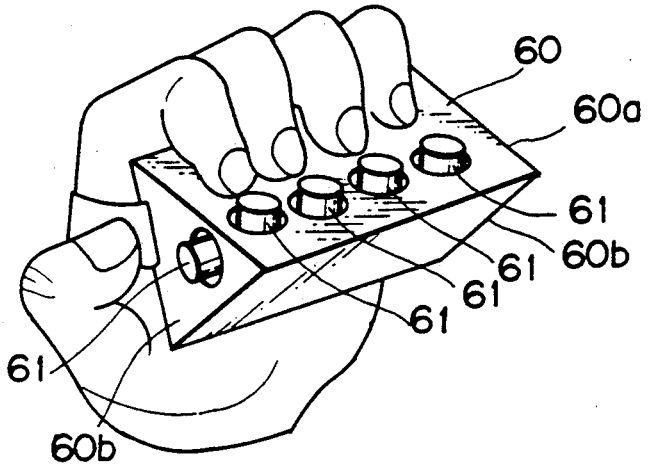
FIG. 32 is a perspective view of used of a handy electronic musical instrument in accordance with the present invention.
Figure 33:
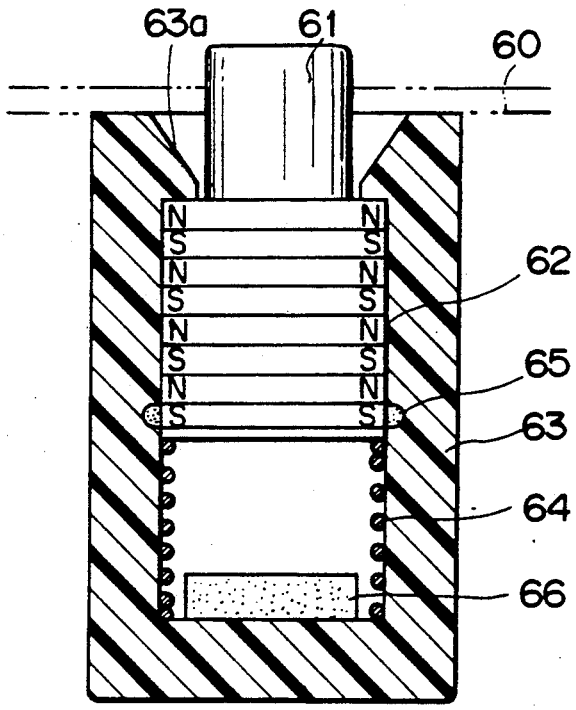
FIG. 33 is a sectional side view of a push botton unit used for the sixth embodiment of the electronic musical instrument in accordance with the present invention.
Figure 34:
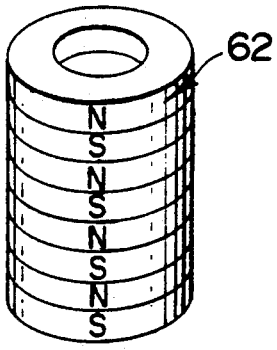
FIG. 34 is a perspective view of a laminated magnet fixed to its push botton key.
Figure 35A:
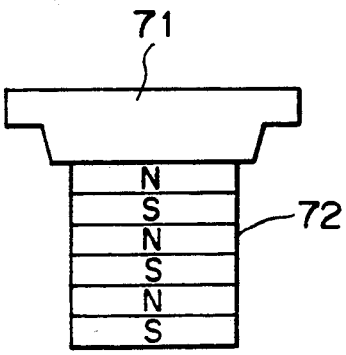
FIGS. 35A and 35B are explanatory views of the main part of the seventh embodiment of the electronic musical instrument in accordance with the present invention.
Figure 35B:
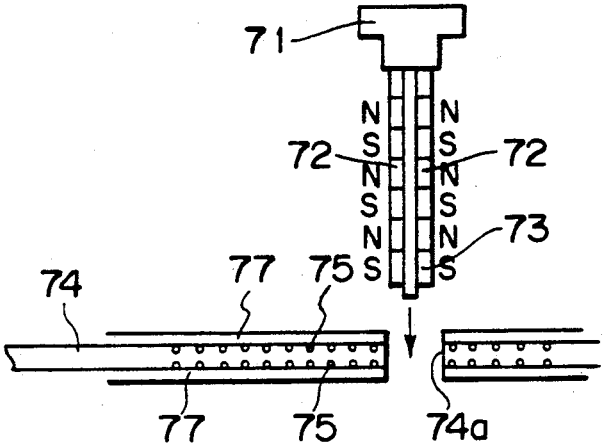
Figure 36:
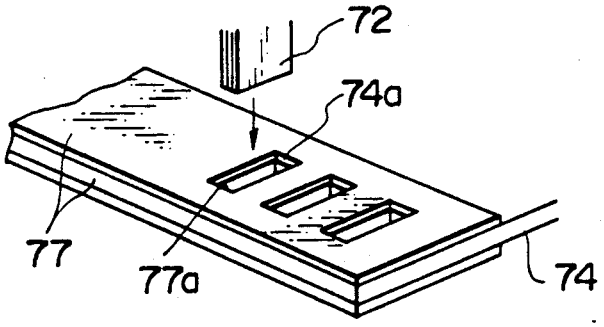
FIG. 36 is its perspective view.
Figure 37:
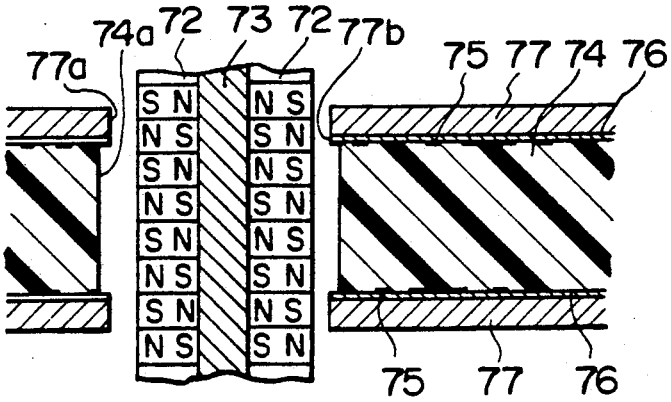
FIG. 37 is a sectional side view of its magnet plate and coil.

The sixth embodiment of the electronic musical instrument in accordance with the present invention is shown in FIGS. 32 to 34 in which the instrument has a portable design suited to be held by hand. This instrument includes a prism type hand piece 60 provided on its top face 60*a* with four push buttons 61 and on its side face 60*b* with one push button 61. The push buttons 61 on the top face 60*a* are for operation by the index, middle, ring and little fingers whereas the push button 61 on the side face 60*b* is for operation by the thumb of a player. Depression of the push buttons 61 causes generation of musical tones of different tonal pitches. So by holding a pair of instruments of this type of different tone ranges in two hands, the player can carry out performances of various modes.

The construction associated with each push button 61 is shown in detail in FIG. 33 in which the push button 61 is accompanied at the bottom with a cylindrical laminated magnet 62 having N- and S-poles superimposed in an alternating fashion as shown in FIG. 34. The laminated magnet 62 is accommodated in an axial blind bore formed in a resin casing 63 embedded in the hand piece 60 and urged to move upwards by a compression spring 64 interposed between the bottom of the laminated magnet 62 and the bottom wall of the resin casing 63 so that the head of the push button 61 should always project outside the bore in the resin casing 63. A ring coil 65 is circumferentially embedded in the wall of the bore in the resin casing 63 at about the middle of its depth and a cushion 66 is bonded to the bottom of the bore. A conical depression 63*a* is formed in the top face of the resin casing 63 in order to give a long stroke for depression of the push button 61.

When the push button 61 is depressed against repulsion by the compression spring 64, the laminated magnet 62 moves downwards to cause a change in magnetic fluxes around the ring coil 65. This change in magnetic fluxes induces alternate flows of current in opposite directions in the ring coil 65, thereby generating pulses of different polarities.

This construction can be generally applied to various electronic musical instruments. For example, each key of an electronic musical instrument may be operationally coupled to a member corresponding to the push button 61 used in this embodiment.

Another example of the push button type, i.e. the seventh embodiment of the electronic musical instrument in accordance with the present invention is shown in FIGS. 35A to 37 in which a push button 71 is provided with a center bank 73 projecting downwards from its bottom face. This center bank 73 is sandwiched by a pair of magnet plates 72 each including N- and S-poles magnetized at alternating positions. A print board 74 mounted to the frame is provided with slits 74*a* for passage of the push button 71. Each slit 74*a* is surrounded on both faces of the print board 74 by coils 75. The coils 75 are firmly held on the print board 74 by a pair of yokes 77 via insulating layers 76 and each yoke 77 has slits 77*a* at positions corresponding to the slits 74*a* in the print board 74.

On depression of a push button 71, an associated pair of magnet plates 72 penetrates the slit 74*a* in the print board 74 passing by the positions of the coils 75 and a corresponding change in magnetic fluxes causes flow of induced current in the coils 75, thereby generating a number of pulses. During this process, concentration of magnetic fluxes takes place at edges of the yokes 77 to increase the pulse current flowing through the coils 75. This embodiment can be applied for an usual electronic musical instrument, too.

The eighth embodiment of the electronic musical instrument in accordance with the present invention is shown in FIGS. 38 to 41 in which pulses are generated in a photoelectric manner in response to key movement on the basis of the Moire stripe principle. A heavy magnet block 82 is fixed to the bottom face of a key 81 and a pair of frames 82 and 83 are fixed to a frame not shown whilst being spaced from each other in the longitudinal direction of the key 81.

Figure 38:
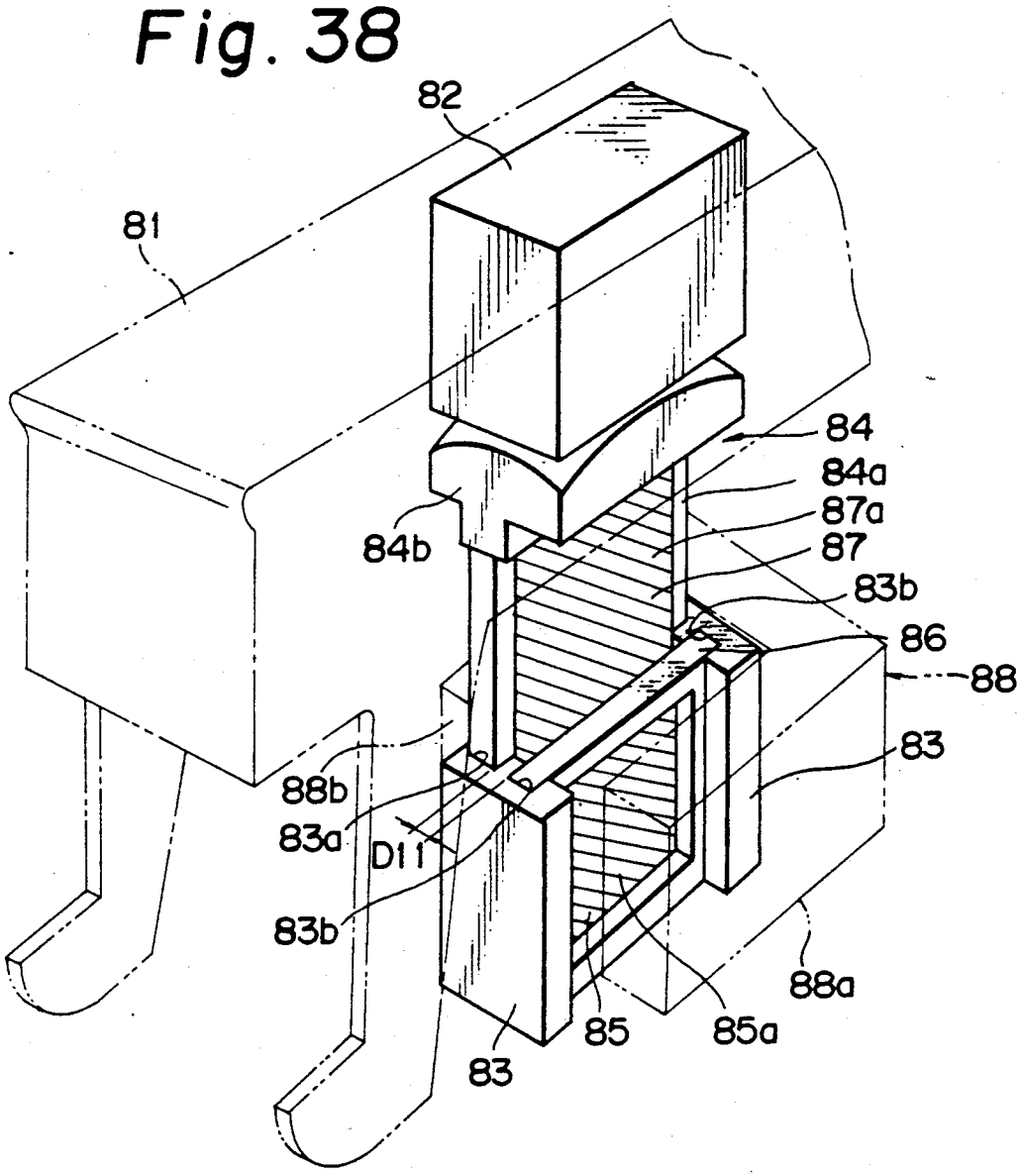
FIG. 38 is a perspective view of the keyboard unit of the eighth embodiment of the electronic musical instrument in accordance with the present invention.
Figure 39:
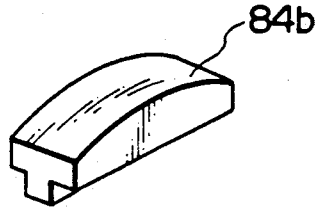
FIG. 39 is a perspective view of a different embodiment of its slide piece.
Figure 40:
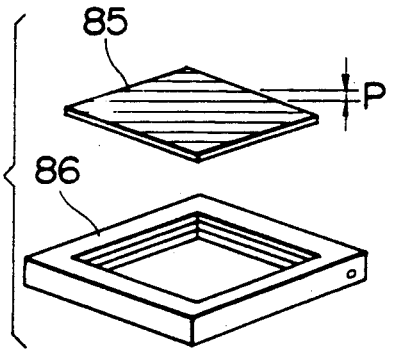
FIG. 40 is a perspective view of its fixed pattern frame and fixed pattern plate in a disassembled state.

One frame 83 is provided with a pair of vertical grooves 83*a* and 83*b* spaced from each other in the width direction of the key 81 and one groove 83*a* idly receives a slide frame 84*a* of a slide unit 84 which is provided at its top with a magnet 84*b* in magnetic contact with the overhead magnetic block 82. For this contact, the magnet 84*b* is provided with a round top face such as shown in FIG. 38 or a cylindrical top face such as shown in FIG. 39. The other groove 83*b* receives a fixed pattern plate 85 which is provided with a stripe pattern 85*a* including transparent and opaque sections at alternating positions with a pitch P as shown in FIG. 40. In correspondence with this, the slide unit 84 is provided with a mobile pattern plate 87 fixed to its slide frame 84*a*. The mobile pattern plate 87 is provided with a stripe pattern 87 which has transparent and opaque sections at alternating positions with a pitch same as that of the stripe pattern 85*a* on the fixed pattern plate 85 but with a small inclination with respect thereto. Preferably, the fixed and mobile pattern plates 85 and 87 are arranged with their mating faces as close as possible. For example, the intervening distance $D_{11}$ should be equal to 0. On different sides of the fixed and mobile pattern plates 85 and 87 are arranged a light emitting element 88*a* and a light collecting element 88*b* of a penetrating type photosensor 88. Alternatively, a reflecting type photosensor may be used with its light emitting and collecting elements arranged on a same side of the fixed and mobile pattern plates 85 and 87.

Figure 41:
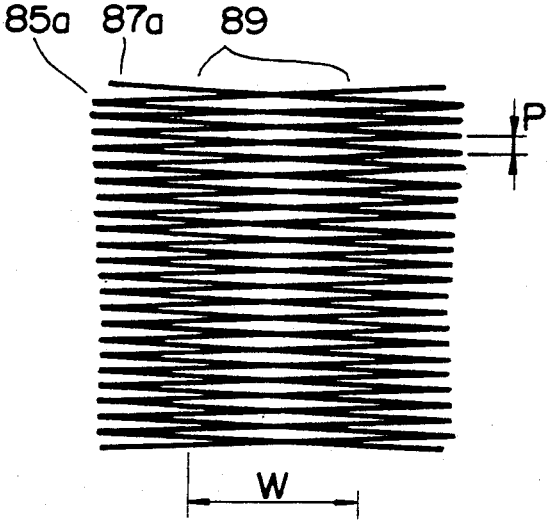
FIG. 41 is an explanatory view of its Moire stripe generation.

As the key 81 is depressed, the magnetic block 82 moves downwards to urge the slide unit 84 downwards. Presence of a curved plane at the top of the magnet 84*b* ensures smooth linear movement of the slide unit 84 along the groove 83*b* in the frame 83 despite the swing movement of the magnetic block 82 caused by the key movement. Due to the lowering of the slide unit 84, its mobile pattern plate 87 overlaps the fixed pattern plate 85 on the frame 83 to produce vertical Moire stripes 89 such as shown in FIG. 41, which move in a horizontal direction in accordance with the movement of the mobile pattern plate 87. On return movement of the key 81, the mobile pattern plate 87 automatically resumes the position shown in FIG. 38 due to magnetic attraction between the magnet 84*b* and the magnetic block 82.

It is known that the following relationship exist in production of a Moire pattern.

$$W' = P/2 \sin(\theta/2) \quad (1)$$

W; the interval of the Moire pattern 89
P; the pitch of the stripe patterns 85*a* and 87*a*
$\theta$; the angle of inclination in radians between the stripe patterns 85*a* and 87*a*

When the angle of inclination ($\theta$) is sufficiently small, the following approximation can be employed.

$$W = P/\theta \quad (2)$$

By this method a slight movement of the mobile pattern plate 87 brings about a rapid movement of the Moire stripe 89. That is, a slight key movement can produce a great number of Moire stripes. When the pitch P of the stripe patterns 85*a* and 87*a* is equal to 0.1 mm, a key movement of 10 mm stroke can produce 100 stripe crossings. Detection of such stripe crossings by the photosensor generates a great number of pulses.

The angle of inclination of the stripe patterns 85*a* and 87*a* is preferably chosen so that the interval of the resultant Moire stripe should be larger than the degree of resolution of the photosensor. In an alternative example, a magnet may be attached to the key 81 and the slide unit 84 may be made of a magnetic substance.

Figure 42:
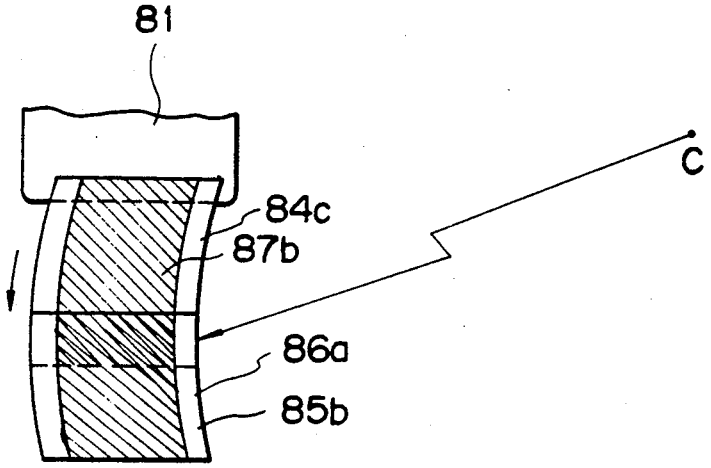
FIG. 42 is an explanatory view of one modification of this embodiment.

In one modification of the instrument based on the Moire stripe principle shown in FIG. 42, pattern plates 85*b* and 87*b* are attached to mobile and fixed pattern frames 84*c* and 86*a* defined by imaginary cylindrical planes having their centers on a support C that is, the fixed pattern frame 84*c* is fixed to a part of the key or the hammer. With this arrangement of the fixed and mobile stripe patterns, the angles both of stripe patterns are small during the starting period but rendered large during the terminal period of key depression. As a consequence, the Moire stripe is small in number during the starting period and large during the terminal period, thereby assuring generation of lots of pulses per a small extent of key movement in after touch control.

The effects accruing from employment of the above-described Moire stripe principle will now be explained in more detail in reference to FIGS. 38 and 41 to 44. In the condition that the fixed and mobile pattern plates 85 and 87 overlap as shown in FIG. 38, the illustration in FIG. 41 is magnified in FIGS. 43 and 44 in which stripes in the stripe patterns 85*a* and 87*a* are illustrated deliberately very fine for better understanding of the principle.

Figure 43:
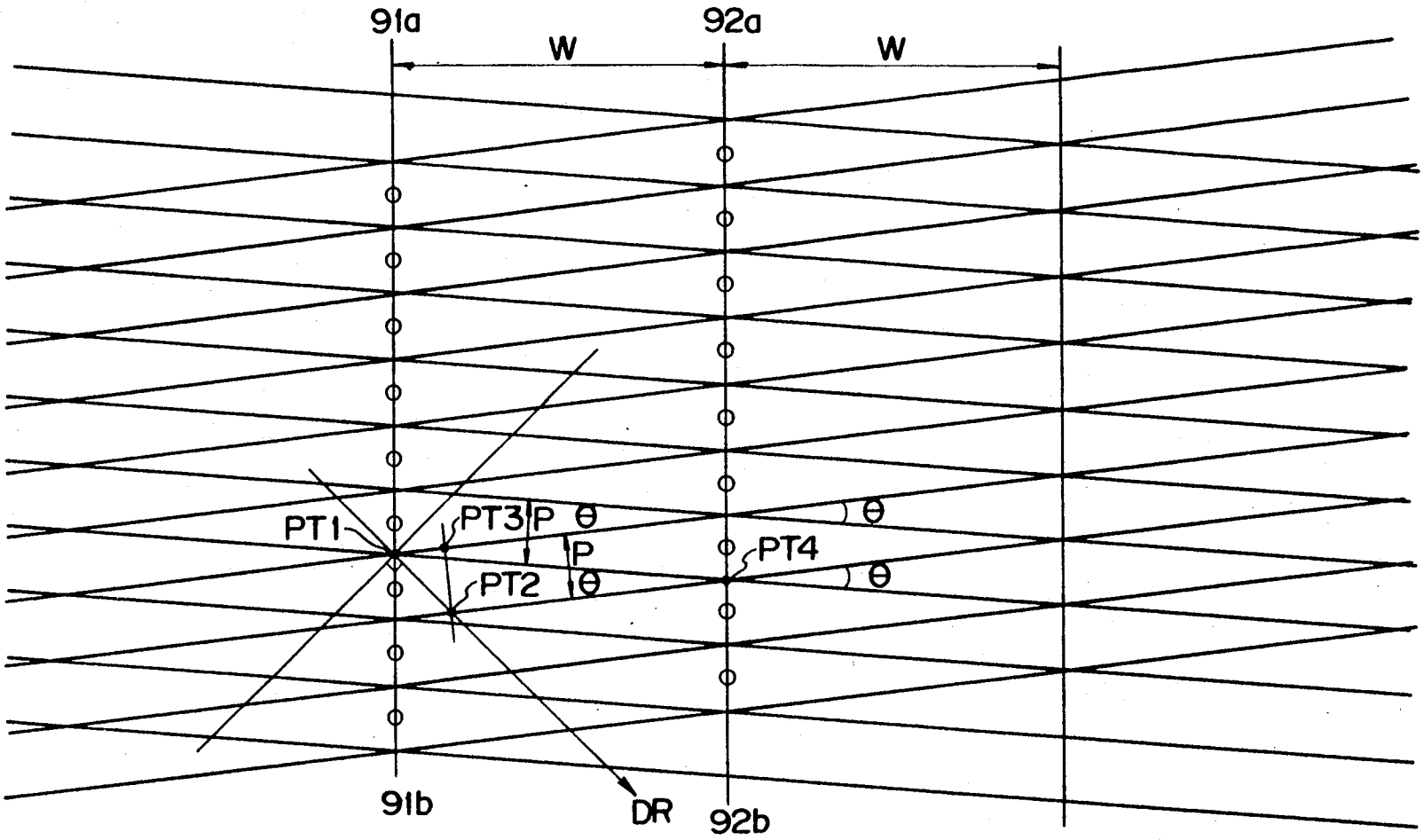
FIGS. 43 and 44 are pattern diagrams of the Moire pattern generated by the eighth embodiment.

As best seen in FIG. 43, the distance between lines (i.e. lines 85*a* and 87*a* in FIG. 44) is largest on lines 91*a*–91*b* and 92*a*–92*b* connecting cross points of lines as marked with symbols "○". Whereas the distance between lines is smaller at positions between the lines 91*a*–91*b* and 92*a*–92*b*. The opaque sections of the Moire stripe are produced in this area of smaller inter-line distance. That is, when the lines in FIG. 43 are drawn slightly thinner than the above-described pitch P shown in FIG. 41, the area of the smaller distance becomes opaque and the area of the large distance appears transparent. Such opaque and transparent sections form the Moire stripe pattern.

Scanning of a lot of Moire stripes by a small key movement will now be explained in reference to FIG. 44 in which the above-described transparent sections appear on the lines 91*a*–91*b* and 92*a*–92*ba*. The following explanation will be focused upon such transparent sections for simpler understanding.

By moving the mobile pattern plate 87 in the direction of key depression DR, a cross point PT1 moves to a cross point PT4 via a cross point PT1'. This means the fact that the line 87*a*1 moves to a line 87*a*$_2$ and, as a consequence, the distance of movement of the mobile pattern plate 87 is equal to D. The Moire stripe pattern moves over a distance of W in FIG. 41 in a inclined direction when the distance of key movement is equal to D. Thus, the multiplification factor of movement (BY) is given by the following equation.

$$BY = W/D \quad (3)$$

Figure 44:
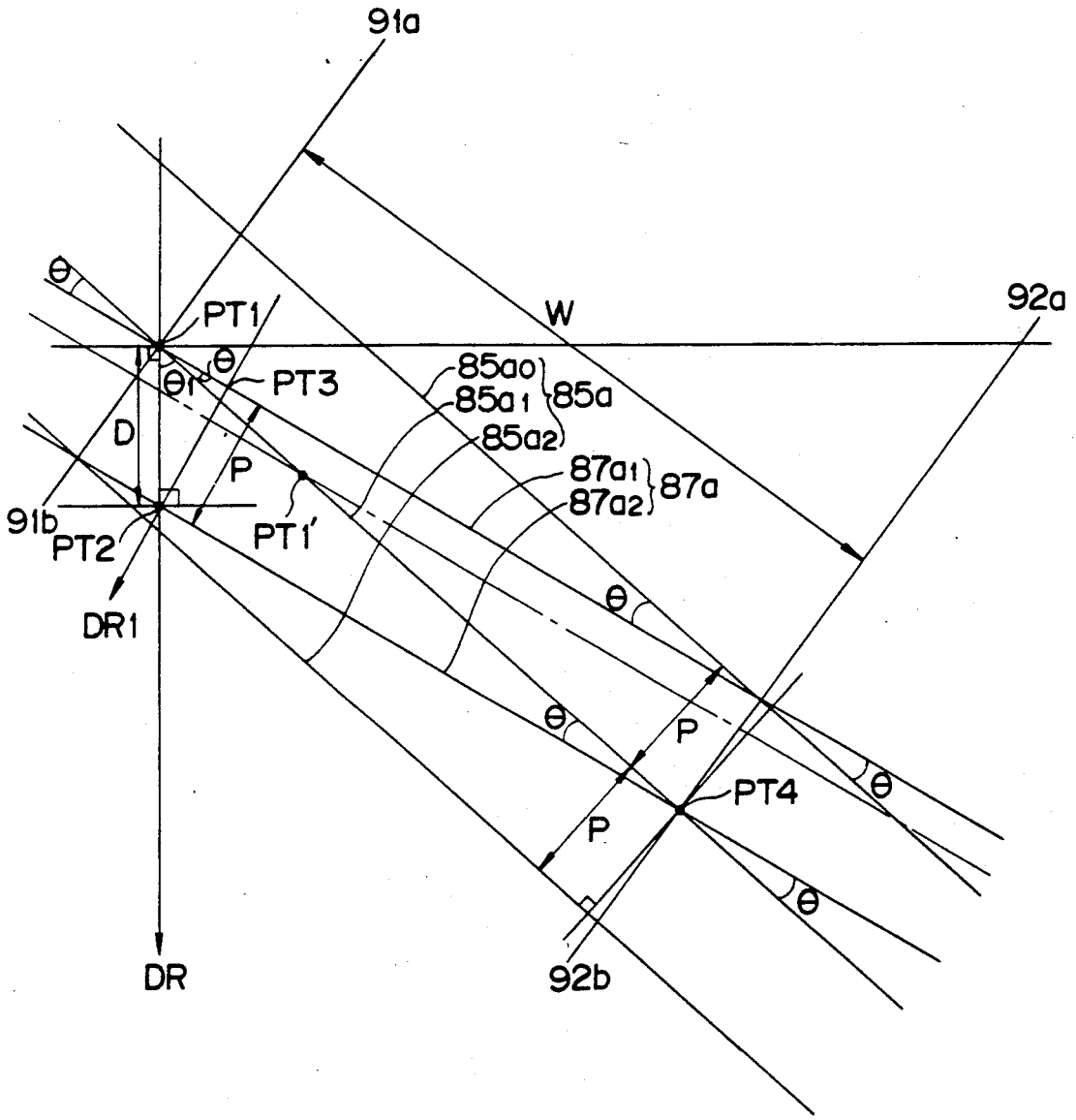

Watching a triangular PT1-PT2-PT3 in FIG. 44, the following relationship is conducted.

$$D = P/\sin(\theta + \theta_1) \quad (4)$$

Here, $\theta_1$ is an angle formed between the fixed pattern line 85*a* and the direction DR of key depression. Then, the following relationship is conducted from the foregoing equations (1) to (4).

$$\begin{aligned} BY &= [P/2\sin(\theta/2)]/[P/\sin(\theta + \theta_1)] \\ &= P\sin(\theta + \theta_1)/2P\sin(\theta/2) \\ &= \sin(\theta + \theta_1)/2\sin(\theta/2) \end{aligned} \quad (5)$$

When the angle $\theta$ is equal to 2 degrees, the angle $\theta_1$ is equal to 45 degrees and the pitch P is equal to 0.1 mm, the multiplification factor BY is calculated from the equation (5) as follows;

$$BY = \sin(45 \text{ degrees})/2 \sin(1 \text{ degree}) = 20.95 \text{ (times)}$$

Thus, the system operates as if the key moved 20.95 times larger than its actual distance of movement. The interval of the Moire stripe pattern W is calculated from the equation (1) as follows;

$$W = 0.1(\text{mm})/2 \sin(1 \text{ degree}) = 2.865(\text{mm})$$

Further, the number N of the Moire stripes pass by the photosensor is calculated as follows;

$$N = 209.5(\text{mm})/2.865(\text{mm}) \approx 73$$

The correctness of this calculation can be endorsed by another way of consideration. That is, the number N is calculated as follows too;

$$N = 10(\text{mm})/0.1(\text{mm}) \times \sin(45 \text{ degrees}) \approx 73$$

From these calculations it will be clear that the number N is equal to 100 if the value of $(\theta + \theta_1)$ is equal to 90 degrees.

In the case of the foregoing embodiments, the musical tone controller is given in the form of a key on a keyboard electronic musical instrument as well as a push button on a portable electronic musical instrument. The present invention, however, is also applicable to an expression pedal unit which is generally used for tone volume control on an electronic musical instrument. One example of such an expression pedal unit is disclosed in Japanese Utility Model Application Laid Open Sho. 60-152197 which is used even separate from a musical instrument. The ninth embodiment of the electronic musical instrument in accordance with the present invention shown in FIG. 45 incorporates such a unique application. It should further be noted that this embodiment is also applicable to a built-in type expression unit such as disclosed in Japanese Utility Model Application Laid Open Sho. 62-46498.

Figure 45:
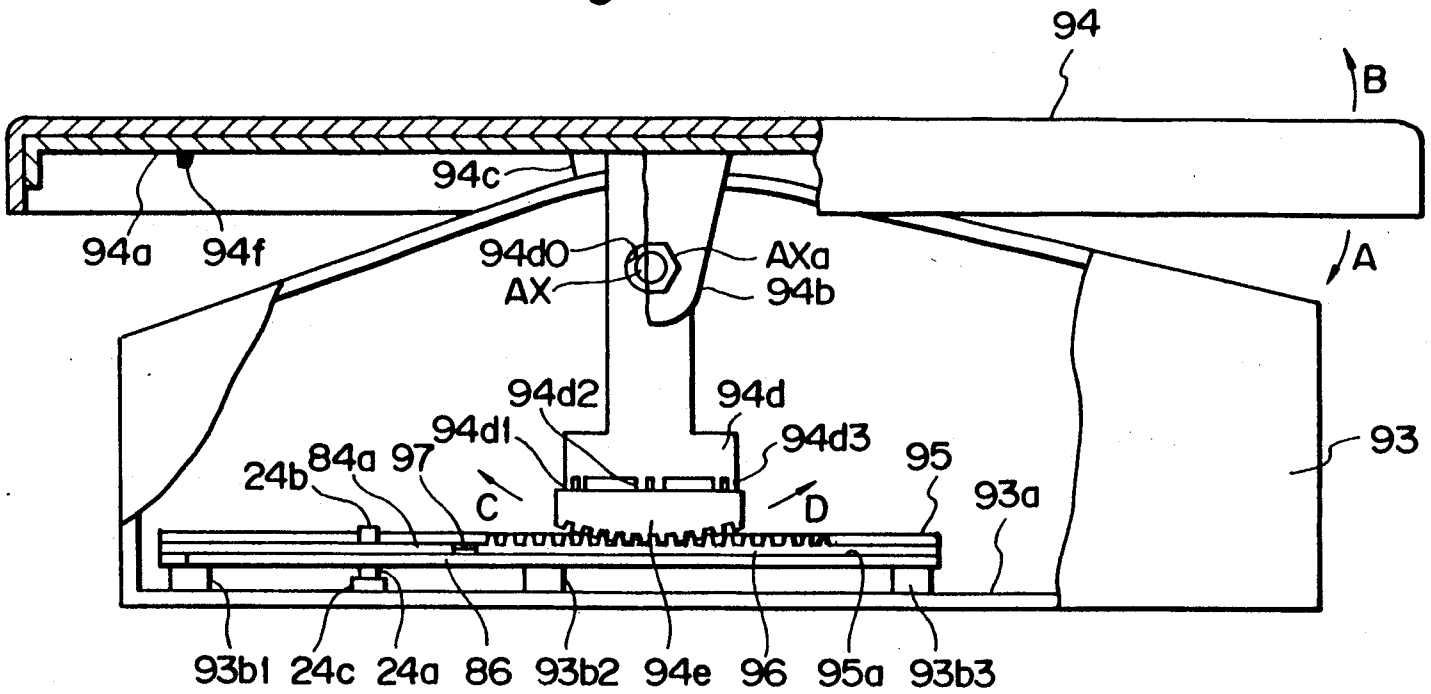
FIG. 45 is a side view, partly in section, of the expression pedal unit of the ninth embodiment of the electronic musical instrument in accordance with the present invention.

In FIG. 45, a foot pedal 94 is pivotally mounted to a frame 93 via a pin AX fastened by a nut AXa and a pair of webs 94*b* and 94*c*. This foot pedal 94 is made of plastic material and backed up by a metallic base 94*a* fixed to its bottom face by locker 94*f*. At about the middle of its length the foot pedal 94 is provided with a drive tongue 94*d* projecting downwards. The drive tongue 94*d* is accompanied at its lower end with three pawls 94*d*1 to 94*d*3 which hold a pinion 94*e* underneath the bottom end of the drive tongue 94*d*.

Three spacers 93*b*1 to 93*b*1 to 93*b*3 are arranged on the bottom face 93*a* of the frame 93 to hold a pair of overhead guide members 95 each having an angled groove 95*a*. The pair of guide members are arranged in parallel to each other with their angled grooves 95*a* in a face-to-face disposition. A rack 96 and a slide frame 84*a* are slidably received in the grooves 95*a* in the guide members 95. In this state held in the grooves 95*a*, the rack 96 is kept in meshing engagement with the pinion 94*e* coupled to the drive tongue 94*d* of the foot pedal 94. Facing the slide frame 84*a*, a fixed pattern frame 86 is fixed to the bottom face 93*a* of the frame 93. The slide frame 84*a* and the fixed pattern frame 86 are provided with stripe patterns same as that shown in FIG. 38 which can produce a Moire stripe pattern.

A light emitter 24*a* is arranged on the bottom face 93*a* of the frame 93 via the spacers 24*c* at a position just below the central section of the fixed pattern frame 86. Facing this light emitter 24*a*, is held a light collector 24*b* fixed to the guide member 95 or to the bottom face 93*a* of the frame 93.

When the foot pedal 94 is pushed in the direction of an arrow A in the drawing with the operator's heel on the left end of the pedal in the illustration, the pinion 94 swings in the clockwise direction as shown with an arrow C and the rack 96 is driven for leftward movement with the slide frame 84*a*. Since the associated stripe patterns are designed to produce Moire stripe patterns as stated above, one push down of the pedal 94 produces one pulse on the output line of the light collector 24*b* per one stripe. This pulse signal is used as a signal CK1 in the circuit shown in FIG. 46 and a signal CK2 in the circuit shown in FIG. 53. Use of the rack-pinion combination in this embodiment presents comfortable feel of resistance against operation by player's foot.

In addition to the foregoing application, the present invention is applicable to a knee lever unit such as disclosed in Japanese Patent Application Laid Open Sho. 62-187890. For example, a slide member shown in FIG. 1 of this earlier application can be replaced by a slide frame 84*a* used for the eighth embodiment shown in FIG. 38, a mobile pattern plate 87 in the moving ambit of the slide frame 84*a* and a fixed pattern plate 85 on a frame of the knee lever unit. By designing stripe patterns as in the foregoing embodiment, like Moire stripe patterns can be produced in the system.

It should be understood that the present invention is similarly applicable to joy-stick controllers. Further, various parts used for the above-described embodiments are exchangeable with each other. Since pulses are generated in non-contact mode in correspondence with the extent of movement of each controller, the instrument can well endure long use with minimal change in function. Lots of pulse signals can be issued with minimal output lines for each key.

Figure 46:
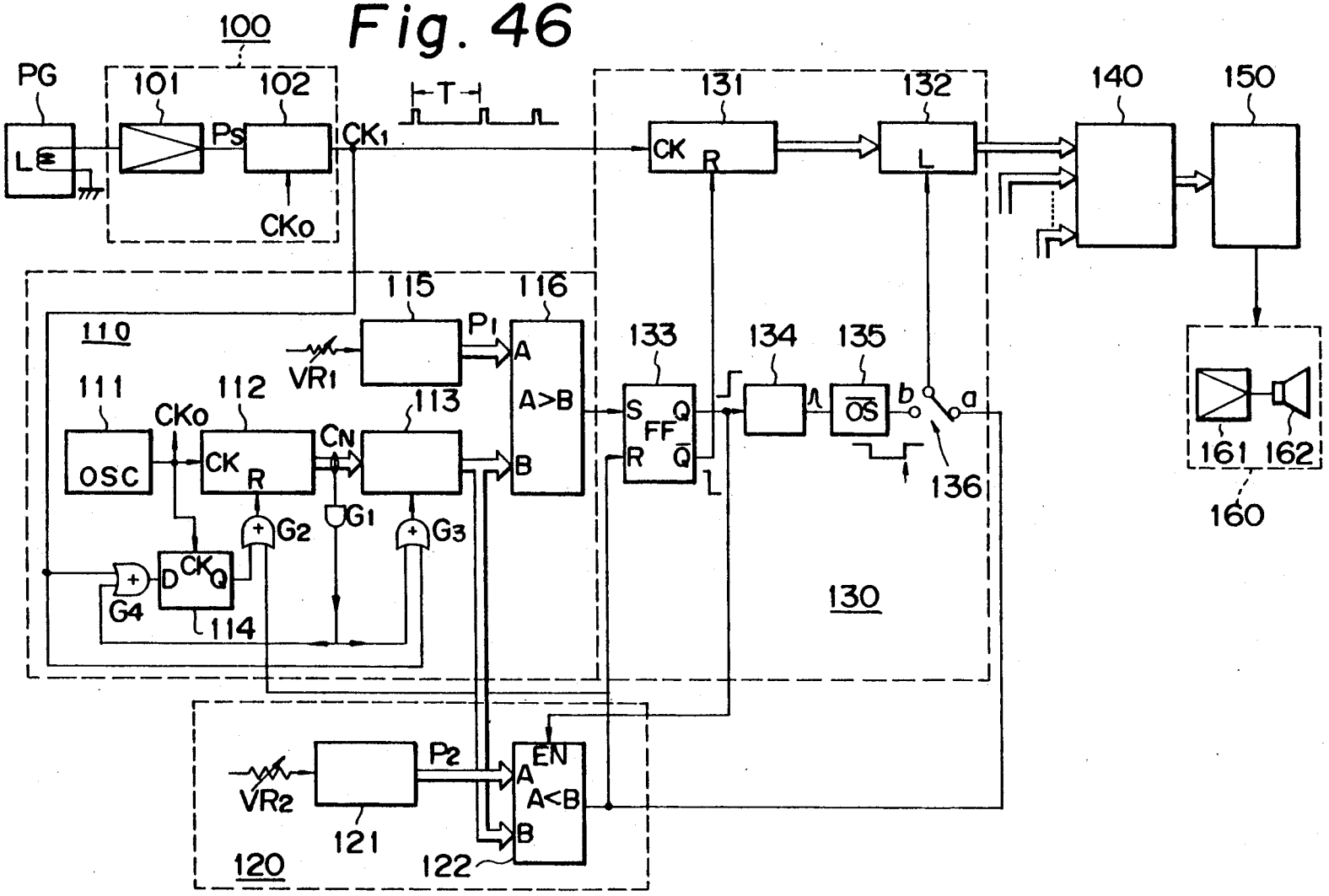
FIG. 46 is a circuit diagram of the first embodiment of the circuit in accordance with the present invention.

Explanation will further be directed to the construction of the musical tone control parameter changing means. The first embodiment of the parameter changing means is shown in FIG. 46. The illustrated circuit includes, as the major components, a key operation pulse detection circuit 100 electrically connected to a pulse generator PG, i.e. the pulse generating means such as shown in FIGS. 1 to 45, a keying detection circuit 110 connected to the output side of the key operation pulse detection circuit 100, a touch data formation circuit 130 connected to the output sides of the foregoing two circuits 100 and 110, a key termination detection circuit 120 interposed between the keying detection circuit 110 and the touch data formation circuit 130, and a sound system 160 connected to the output side of the touch data forming circuit 130 via a multiplicating circuit 140 and a musical tone generating circuit 150. Here, the key operation pulse detecting circuit 100, the keying detecting circuit 110, the key termination detection circuit 120 and the touch data formation circuit 130 are each provided one for each musical tone controller, i.e. each key in the case of a keyboard electric musical instrument which is exemplified in the following descriptions.

The key operation pulse detection circuit 110 has a function to carry out wave shaping of pulses issued by the pulse generator PG. In this case, pulses are generated in magnetic manner. This key operation pulse detection circuit 100 includes an amplifier 101 and a wave shaper 102. On receipt of a pulse signal in current form from a coil L, which corresponds to the coils 10, 48*a*, 56, 65 and 75 in the foregoing embodiments of the pulse generating means, the amplifier 101 amplifies and converts it into a pulse signal in voltage form. The wave shaper 102 performs shaping of an output pulse signal Ps from the amplifier 101 via differentiation and issues a key operation pulse Ck1 with a pulse width of a clock pulse CK0 received from a later-described high speed oscillator 111 of the keying detection circuit 110.

Figure 6D:
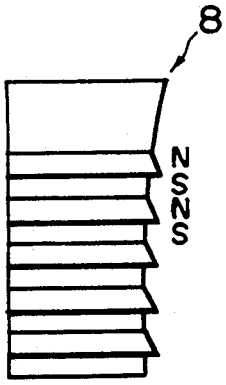
Figure 47A:
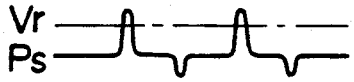
FIGS. 47A and 47B are wave diagrams of pulse signals generated at key depression and return of the key depression.
Figure 47B:
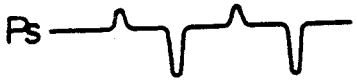

When the yoke associated with the coil L is constructed as shown in FIG. 6D, the output pulse signal Ps from the amplifier 101 includes a large rise with a small fall during depression of the key as shown in FIG. 47A and a small rise with a large fall during return from key depression as shown in FIG. 47B. If wave shaping is carried out at the wave shaper 102 in a manner such that only pulses exceeding the threshold level Vr shown in FIG. 47 should be picked up, no key operation pulses CK1 are issued during return from key depression.

Figure 48:
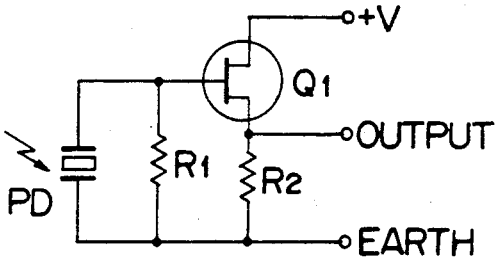
FIG. 48 is circuit diagram of one example of the light reception circuit for the photosensor in accordance with the present invention.
Figure 49:
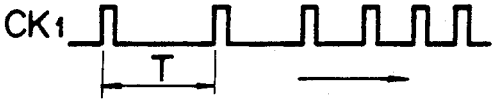
FIG. 49 is a wave diagram of the key operation pulse generated.

When pulses are generated in photoelectric manner at the pulse generator PG, output signals from the photosensors 24, 34, 53 and 84 may be passed to the wave shaper 102. Such a photosensor includes a light collector such as shown in FIG. 48 in which the light collector includes a light collecting element PD, a FET Q1 and resistances R1 and R2.

The key operation pulse detection circuit 100 may be constructed so that it should issue the key operation pulse CK1 during key depression only on receipt of a pair of pulse signals with a phase lag of 90 degrees from the pulse generator PG, thereby discriminating direction of the key movement. In this case, the key operation pulse detection circuit 100 has a function to detect a phase lag in the pulse signals received from the pulse generator PG.

The keying detection circuit 110 includes a normally operating high speed oscillator 111, the first counter 112 connected to the output side of the oscillator 111 to count clock pulses CK0 from the oscillator 111, a latch 113 connected to the output side of the counter 112 to latch count values from the counter 112, an AND-gate G1, OR-gates G2 to G4, a D-type flip-flop 114 interposed between the oscillator 111 and the latch 113, the first preset value setter 115 which sets the first preset value P1 via a volume VR1 and the first comparator 116. The comparator 116 is provided with a terminal A for receipt of the first preset value P1 and a terminal B for receipt of a count value latched at the latch 113. The comparator 116 compares the count value at the terminal B with the first preset value at the terminal A to issue a keying signal of level "1" when the first preset value is larger than the count value.

The key termination detection circuit 120 includes the second preset value setter 121 for setting the second preset value P2 and a comparator connected to the second preset value setter 121. The comparator 122 is provided with a terminal A for receipt of the second preset value P2 and a terminal B for receipt of the count value from the latch 113 of the keying detection circuit 110. The comparator 122 compares the count value at the terminal B with the second preset value P2 at the terminal A to issue a key termination signal of level "1" when the second preset value P2 is smaller than the count value.

The touch data formation circuit 130 includes a counter 131 for counting the key operation pulses CK1 from the key operation pulse detection circuit 100, a latch 132 for latching the count value from the counter 131, a flip-flop 133, a differentiation circuit 134 connected to one output terminal Q of the flip-flop 133, a one-shot multi-vibrator 135 and a switch 136. The set terminal of the flip-flop 133 is connected to the output side of the first comparator 116 of the keying detection circuit 110 whereas the reset terminal R to the output side of the second comparator 122 of the key termination detecting circuit 120. The other output terminal of the flip-flop 133 is connected to the reset terminal R of the counter 131. The multi-vibrator 135 may include a NOT-gate.

The preset values P1 and P2 are chosen close to the maximum count value $C_{MAX}$ of the first counter 112 of the keying detection circuit 110.

The system shown in FIG. 46 operates as follows. No key operation pulse CK1 is issued by the key operation pulse detection circuit 100, before the key is depressed.

The first counter 112 of the keying detection circuit 110 counts the clock pulses CK0 from the oscillator 111 and, when its count value reaches the maximum count value $C_{MAX}$, input signals to the AND-gate G1 are all at level "1". As a consequence, the keying detection circuit 110 issues an output signal of level "1" which is passed to the latch via the OR-gate G3. The latch 113 issues its full count value $C_{MAX}$ after latching.

When the output from the AND-gate G1 is at level "1", the output signal from the OR-gate G 4 is also brought to level "1". The signal is delayed over one period of the clock pulse CK0 by operation of the flip-flop 114 and its reset signal from the OR-gate G2 is brought to level "1". Thereupon the counter 112 is reset to restart its counting of the clock pulses CK0 from 0. As a consequence, the output signals from the latch 113 are thereafter maintained always at the full count value $C_{MAX}$ which is greater than the first preset value P1 fixed by the setter 115, and the output signal from the first comparator 116 is at level "0". Since the output signal from the latch 113 passed to the terminal B of the second comparator 122 is greater than the second preset value P2 at its terminal A, the output signal from the second comparator 122 is at level "1" to reset the flip-flop 133. Then, the output signal from the terminal reverse Q of the flip-flop 133 is bought to level "1" to reset the counter 131, thereby disenabling the same.

When the switch 136 in the touch data formation circuit 130 is kept in the state shown in the drawing, an output signal of level "1" from the second comparator 122 is passed to the latch 132. However, the counter 131 has started no counting and, as a consequence, issues a count value of 0, and the latch 132 also issues an output signal of level "0". When the output signal from the comparator 122 is at level "1", the counter 112 is reset. At this moment the output signal at the terminal Q of the flip-flop 133 is at level "0" to disenable the comparator 122. As a consequence, reset on the flip-flop 133 and the counter 112 is canceled. This condition is maintained until operation on the musical tone controller, i.e. the key depression, is initiated.

On the key depression, the key operation pulse detection circuit 100 sequentially issues a number of key operation pulses CK1. As stated above, the number of the key operation pulses CK1 is dependent upon the extent of movement of the controller, i.e. the key depression in the present case. Whereas its pulse interval T is inversely proportional to the speed of the key movement. The key operation pulses CK1 so generated is on the one hand passed to the second counter 131 and, on the other hand, to the latch 113 via the OR-gate G3. Further, the key operation pulses CK1 are passed to the reset terminal R of the first counter 112 via the OR-gate G4, the flip-flop 114 and the OR-gate G2. During the initial period of key depression, moving speed of the key is rather small and, as a consequence, the pulse interval T of the key operation pulses CK1 is large. The count values $C_N$ of the first counter 112 are latched by the latch 113 after they exceed the full count value $C_{MAX}$ of the first counter 112. Due to this delay in latching operation, the input signal at the terminal A of the first comparator 116 is maintained smaller than that at the terminal B at this stage of the process and its output signal is still kept at level "0". Thus, the second counter 131 is kept disenabled.

With gradual increase in moving speed of the key, latching operation is carried out even when the count value $C_N$ of the first counter 112 does not reach the level of the first preset value P1 and, at the first comparator 116, the input signal at the terminal A exceeds that at the terminal B. The output signal from the comparator 116 is then brought to level "1" and the rise of this output signal is used as a keying signal. This output signal of level "1" from the first comparator 116 sets the flip-flop 133 whose output signal at the terminal reverse Q is now at level "0" to cancel resetting on the counter 131. Then the second counter 131 is rendered enabled to initiate counting of the key operation pulses CK1 from the key operation pulse detection circuit 100.

On setting of the flip-flop 133, its output signal at the terminal Q is brought to level "1", which enables the second comparator 122 of the key termination detection circuit 120. At the rise of this Q terminal output signal, the differential circuit 134 issues a differential pulse to trigger the one-shot multi-vibrator 135. As a consequence, its output signal is temporarily brought to level "0" for a prescribed period.

When the switch 136 is in b-connection under this condition, the rise of the output signal from the multi-vibrator 135 makes the latch 132 latch the count values from the second counter 131 to issue as touch data. These touch data are made up of count values generated within a prescribed period after the second counter 131 started counting of the key operation pulses CK1 on generation of the keying signal. The faster the key movement, that is the stronger the key touch, the larger the number of the touch data.

When the switch 136 is in a-connection as shown in FIG. 46 under this condition, the rise of the output signal from the second comparator 122 makes the latch 132 latch the count values from the second counter 131 to issue as touch data. When the key is depressed until the lower limit or until a certain middle position due to soft touch, the moving speed of the key is very low and the pulse interval T of the key operation pulses CK1 is rendered large. Then, the count value $C_N$ of the counter 112 becomes larger than the second preset value P2 in the key termination detection circuit 120, which brings the output signal from the second comparator 122 up to level "1". As a consequence, the touch data are made up of count values generated during a period from initiation of counting of the key operation pulses CK1 to termination of the key movement, and correspond to the depth of key depression.

As the output signal from the second comparator 122 is brought up to level "1", the first counter 112 is reset and the second counter 131 is also reset with a delay equal to the reversion period of the flip-flop 133. The comparator 112 is also rendered disenabled as stated above.

By setting the first present value P1 a little smaller than the full count value $C_{MAX}$ of the first counter 112, one can avoid unstable condition of the touch data or operation error which would otherwise be caused by slight key movement during the initial key depression and/or after key depression.

Insensible zones can be provided in the initial and terminal periods of key depression by use of such prescribed values P1 and P2 and the widths of such insensible zones can be adjusted freely by choice of these preset values.

Operation of the circuit shown in FIG. 46 during the initial period of key depression will now be explained in more detail. Here, the switch is supposed to be in the a-connection as shown in the drawing. It is also assumed that the length of time from the full count moment of the counter 112 to the moment of input of the first key operation pulse CK1 is equal to "t", the length of time before the count value $C_N$ reaches the first preset value P1 is equal to "T1" and the length of time before the count value $C_N$ reaches the second preset value P2 is equal to "T2". Needless to say, T1 is shorter that T2. One of the following three relationships are believed to exist between these three timings.

$$t < T1 \quad (1)$$

The latch 113 starts to latch the count value $C_N$ of the counter 112 before the latter reaches the first preset value P1 and, as a consequence, the input signal at the terminal A of the comparator 116 becomes larger than that at the terminal B. This condition causes setting of the flip-flop 133 to enable the second counter 131 and the first key operation pulse CK1 is counted. Since t is smaller than T2, the output signal from the second comparator 122 is kept at level "0" and no resetting of the flip-flop 133 is caused. The latch 132 performs no latching and its output signal remains also at level "0".

$$T1 < t < T2 \quad (2)$$

The latch 113 starts its action after the count value $C_N$ has exceeded the first preset value P1 and, as a consequence, the input signal at the terminal A of the comparator 116 becomes smaller that at the terminal B. As a result, the counter 131 remains disenabled. Since the output signal from the comparator 122 is also at level "0", the latch 132 does not operate.

$$t > T2 \quad (3)$$

The output signal from the comparator 116 is at level "0" and the counter 131 remains disenabled. The input signal at the terminal A of the comparator 116 becomes smaller than that at the terminal B but the comparator 116 remains disenabled because of level "0" state of the output signal from the terminal Q of the flip-flop 133. The level "0" output signal from the flip-flop 133 causes no operation of the latch 132.

There is an error of 1 in the count value $C_N$ of the counter 112 between the case (1) and the cases (2) and (3). Presence of such an error in count value, however, has no virtual influence on the operation of the illustrated circuit, since one time of key depression generates 50 to 100 pulses.

The above-described major circuits are each provided one for one key, i.e. musical tone controller, and the touch data issued by the latch 132 is passed to the multiplicating circuit 140 which transfers the same to the musical tone generating circuit 150 in time division mode. The circuit 150 generates a musical tone signal at a tonal pitch corresponding to the key of the touch data received from the latch 132. Depending on the values of the touch data received, a wide variety of musical tone control parameters can be changed in multi-stage fashion, thereby generating musical tone signals with complete fidelity to delicate change in player's emotion as well as strength and speed of key depression, i.e. operation on the musical tone controller. Such musical tone signals are passed to the sound system 160, which generally includes an amplifier 161 and a speaker 162, for generation of corresponding musical tones via electro-acoustic conversion.

In accordance with the foregoing embodiment of the parameter changing means of the present invention, a keying signal is generated at the moment of prescribed key depression speed to initiate counting of the key operation pulses CK1 by the second counter 131. The above-described prescribed key depression speed can be changed quite freely by adjustment of the first and second prescribed values P1 and P2. This enables free setting of the threshold level of the insensible zone during the initial period of key depression.

Figure 50:
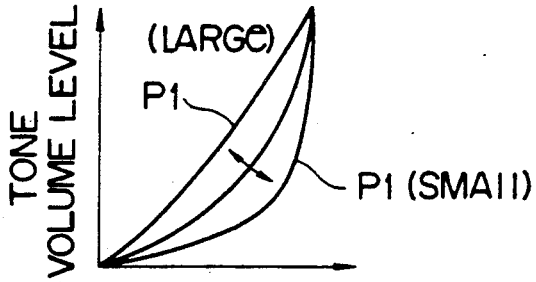
FIG. 50 is a graph for showing the dynamic range change characteristics.

More specifically, the relationship between the touch strength and the tone volume level is shown in FIG. 50. Here the tone volume level of a musical tone is fixed on the basis of touch data obtained in the a-connection state at the switch 136. It is clear from this graphic data that the lower the touch strength, the lower the tone volume level for a small preset value P1. Whereas no significant lowering in tone volume level is observed in the case of high touch strength. Thus an enlarged dynamic range can be expected.

This is due to the following state of signal processing. The key depression speed is low for a low touch strength. When the first preset value P1 is small, initiation of counting of the key operation pulses CK1 by the counter 131 is delayed accordingly after the initial key depression and increased number of pulses are issued without counting. As a result, the size of the touch data from the latch 132 is minimized to lower the resultant tone volume level. In the case of high touch strength, however, even for the small first preset value P1, instant generation of the keying signal and early initiation of counting operation by the counter 131 occur. Then, reduction in number of pulses issued without counting causes no significant change in size of the touch data regardless of the size of the first preset value and, as a result, no lowering in tone volume level takes place.

Such possibility in change of the dynamic range leads to enlarged freedom in trill performance whilst well reflecting delicate change in player's emotion. This merit of the invention can be utilized in tone volume control on an automatic piano too. For example, for memory of the initial touch data with tonal pitch information and note length information, the first preset value P1 is chosen very close to the full count value of the counter 112 or very large. The value is set to a relatively low level for replaying. With this setting of the value, movement of a key caused by a soft touch produces no musical tone, thereby enabling severe reflection of the player's technique.

Although the major circuits are each provided one for each key in the case of the foregoing embodiment, only one set of combination may span a plurality of keys when time division mode is employed in signal processing. The operations of these major circuits may be program controlled via use of a micro-computer too.

Figures 51, 54, 55:
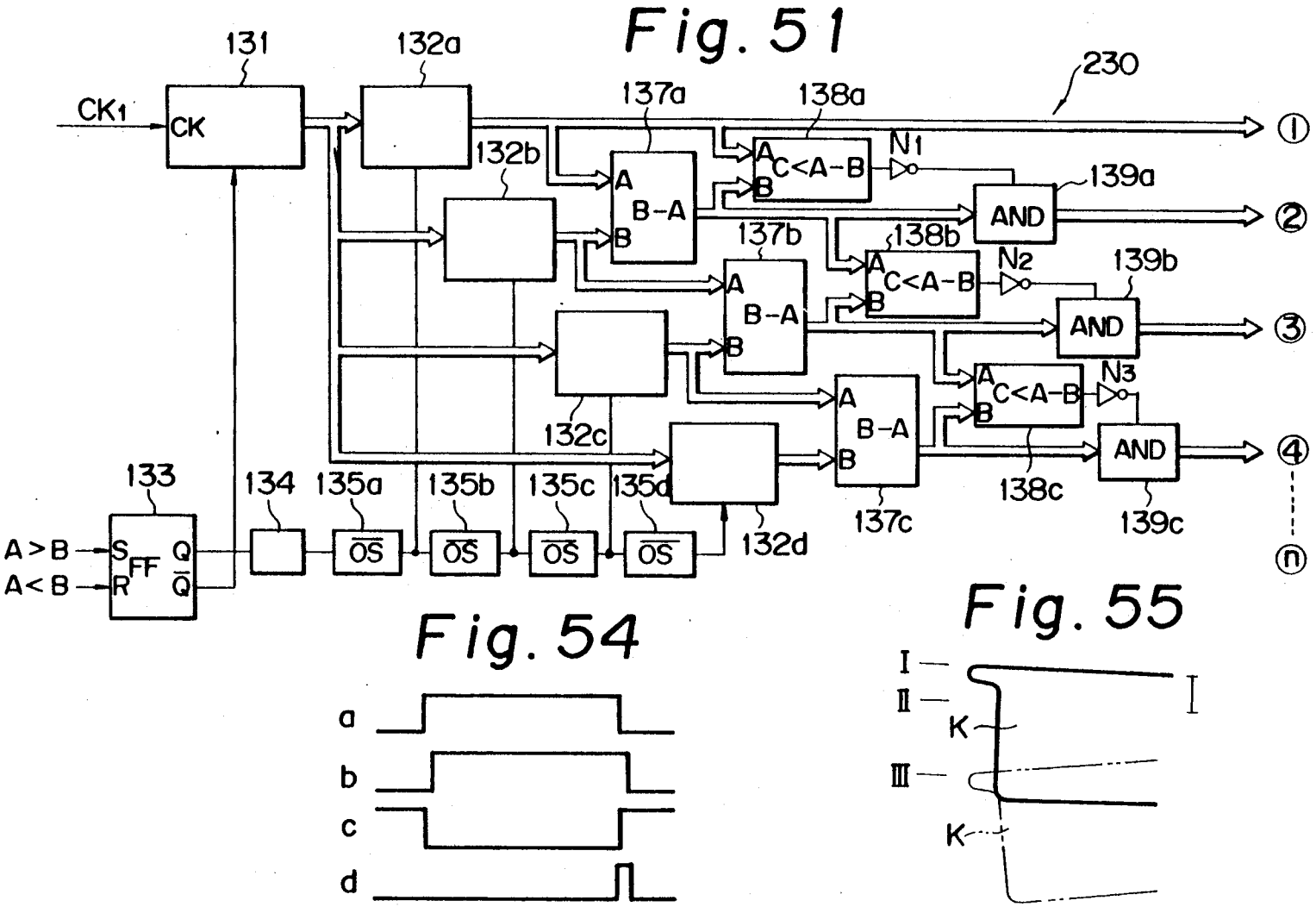
FIG. 51 is a circuit diagram of the main part of the second embodiment of the circuit in accordance with the present invention.
FIG. 54 is a graph for explaining the operation of the detecting circuit.
FIG. 55 is a diagram used for explaining the operation of this embodiment.

The second embodiment of the musical tone control parameter changing means is shown in FIGS. 51 and 52, in which FIG. 51 contains only a circuit section corresponding to the touch data formation circuit 130 in the foregoing embodiment and other circuit sections are substantially same as those used for the foregoing embodiment.

As in the first embodiment, a touch data formation circuit 230 includes the second counter 131, the flip-flop 133 and the differential circuit 134. In addition thereto, the circuit 230 includes four sets of latches **132*a* to 132*d* connected in parallel and four sets of one-shot multivibrators 135*a* to 135*d* connected in series. A rise from level "0" to level "1" in an output signal from each multi-vibrator is used as a latch signal for an associated latch. Three reducers 137*a* to 137*c* are interposed between the output terminals of the latches 132*a* and 132*b*, between the output terminals of the latches 132*b* and 132*c* and between the output terminals of the latches 132*c* and 132*d*, respectively. Each reducer is designed to issue an output signal (B−A) which is a difference between its A terminal input and B terminal input. Together with the output signal from the latch 132*a*, output signals from the reducers 137*a* to 137*c* are put out to a multiplicating circuit 140 as touch data via AND-gates 139*a* to 139*c***.

A comparator **138*a* is provided with an A terminal to receive an output signal (A) from the latch 132*a* and a B terminal to receive an output signal (B) from the reducer 137*a*. On receipt of these signals, the comparator 138*a* issues an output signal of level "1" when C<-(A−B), C being a properly chosen positive integer such as 3. This output signal is reversed at a NOT-gate N1 to be passed to the AND-gate 139*a* as a prohibit signal so that the AND-gate 139*a* should be closed when the inhibit signal is at level "0". Likewise, a comparator 138*b* is arranged on the output sides of the reducers 137*a* and 137*b* so that its output signal should be passed to the AND-gate 139*b* as an inhibit signal after inversion at a NOT-gate N2, and a comparator 138*c* is arranged on the output sides of the reducers 137*b* and 137*c* so that its output signal should be passed to the AND-gate 139*c* as an inhibit signal after inversion at a NOT-gate N3**.

With this construction of the touch data formation circuit 230, the flip-flop 133 is set on receipt of a keying signal which is generated when the output signal from the comparator 116 in FIG. 46 is at level "1". Its resultant output signal of level "0" at the reverse Q terminal enables the counter 131 which thereupon initiates counting of the key operation pulses CK1. Concurrently, the differential circuit 134 issues a differential pulse at rise of the Q terminal output signal from the flip-flop 133 to trigger the multi-vibrator **135*a*. With prescribed time lags, the multi-vibrators 135*b* to 135*d* are triggered one by one to pass latch signals to the latches 132*a* to 132*d* sequentially. So, when the delay time by the multi-vibrator is $\tau$, the latches 132*a* to 132*d* operate at timings $\tau$, $2\tau$, $3\tau$ and $4\tau$ after counting of the key operation pulses CK1 is initiated at the counter 131**.

The output signal from the latch **132*a* is used as touch data (1). Whereas output signals from the reducers 137*a* to 137*c* are used as touch data (2), (3) and (4) after passage through the AND-gates 139*a* to 139*c*. When the output signal from the latch 132*a*** exceeds the value C or when the difference between the output signals of upstream and downstream reducers exceeds the value C, the output signal of each reducer becomes level "1" to make the output signal from an associated NOT-gate be at level "0" and an associated AND-gate is closed to issue no touch data.

Assuming that the output signals from the latches **132*a* to 132*d* are equal to 22, 53, 64 and 64, the touch data (1) are equal to 22. The output signals from the reducers 137*a* to 137*c* are equal to 31, 11 and 0, respectively. The value (A−B) at the comparator 138*a* is then equal to −9. When the value C is equal to 3, the value (A−B) is not smaller than the value C and, as a consequence, the output signal from the comparator 138*a* becomes level "0". Because the output signal from the NOT-gate N1 is at level "1", the AND-gate 139*a* is made open and the output signal 23 from the reducer 137*a* forms the touch data (2). The value (A−B) at the comparator 138*b* is then equal to 20 which is larger than the value C and the output signal from the comparator 138*b* becomes level "1". As a consequence, the output signal from the NOT-gate N2 is at level "0" and the AND-gate 139*b* is closed. The output signal 11 from the reducer 137*b* doesn't form the touch data (3). The output signal from the reducer 137*c* is at level "0" and the AND-gate 139*c* is also closed to issue no touch data (4)**.

Figure 52A:
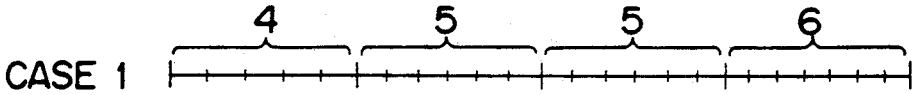
FIGS. 52(A) and 52(B) are its explanatory view.
Figure 52B:
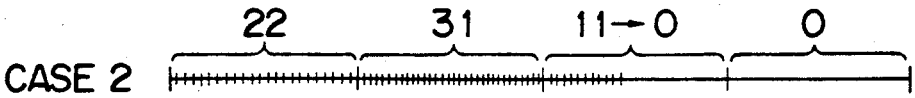

When a key is depressed slowly, input of the key operation puleses CK1 lasts until the latch **132*d* latches the count value from the counter 131 and four latch data are exactly obtained as the case 1 in FIG. 52A. Whereas, when the key is depressed strongly, input of the key operation pulses CK1 terminates before the latch 132*c* starts to latch the count value from the counter 131 as the case 2 in FIG. 52B and output of signals from the reducer 137***b* is inhibited because no correct number of pulses are generated during the period $\tau$. In this case a value obtained by adding the difference between the data (2) and (1) to the data (1) via interpolation may be used for the data (3). In the above-described real example, a value 40=31+9 may be used for the data (3).

This embodiment of the parameter changing means can be used for tone volume control such as control of the attack level of an envelope wave shape utilizing the touch data (1). The touch data (1) to (n) or difference between each touch data (1) to (n) can be used for tone colour control, control of the sustain period of an envelope wave shape and control of pitch variation as well as the depth and speed of vibrato and tremolo. The touch data can also be used for control of tone colour in the next spectrum division (harmonic combination, etc). In this way, this embodiment assures subtle control of musical tones and rich reflection of the player's emotion. By increasing the number of the latches and the multi-vibrators, one key depression period can be divided into more time sections to obtain more touch data.

When the circuit is constructed so that the counter 131 should be reset at every latching operation by the latch to restart its counting operation, the reducers 137*a* to 137*c* can be deleted from the circuit construction. The operation of the touch data formation circuit 230 may be given by software programming on a micro computer too.

Figure 53:
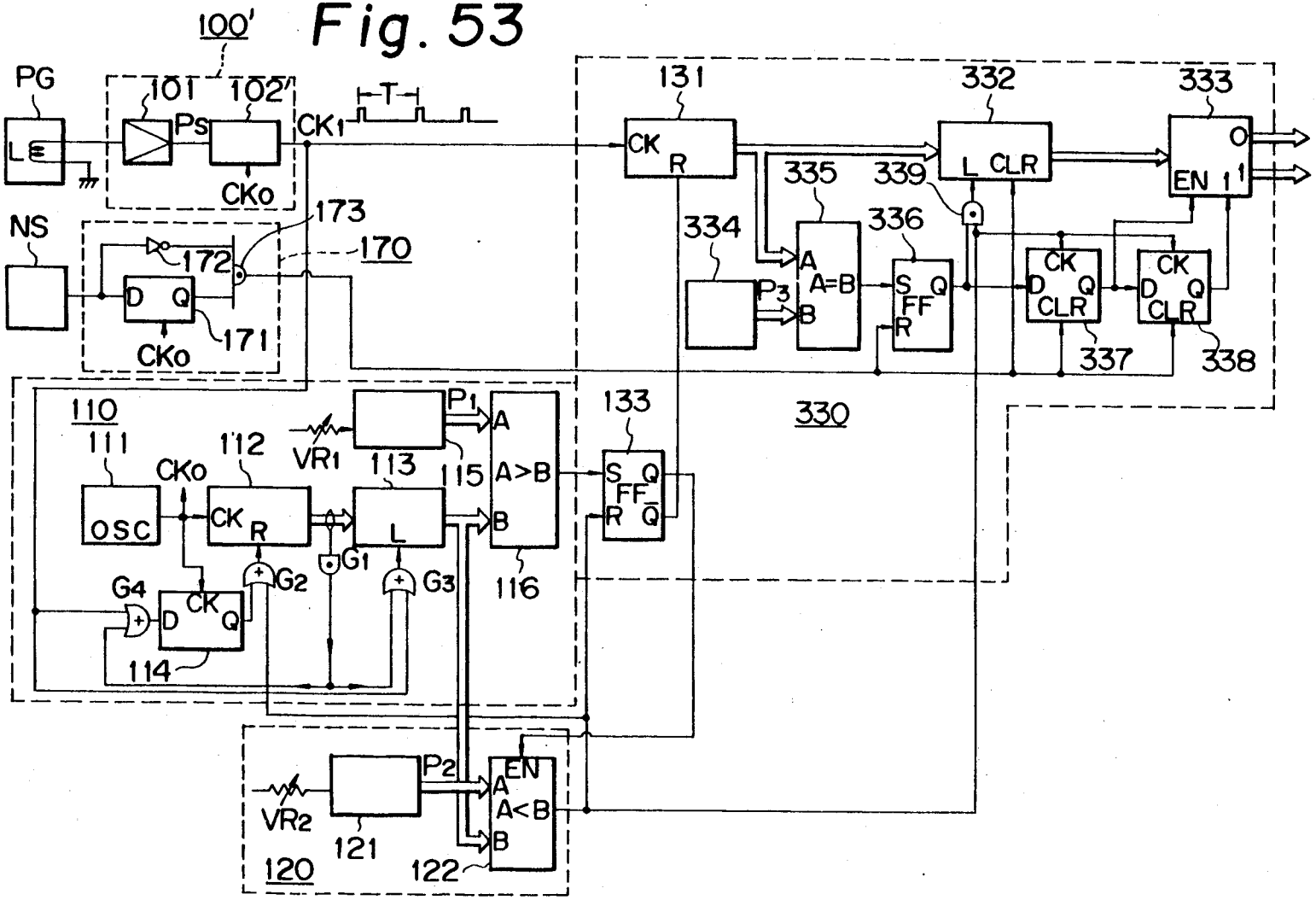
FIG. 53 is a circuit diagram of the third embodiment of the circuit in accordance with the present invention.

The third embodiment of the parameter changing means is shown in FIG. 53 in which the key operation pulses CK1 are issued from a key operation pulse detection circuit 100' after shaping not only during key depression but also during return from key depression. This circuit is different from the foregoing embodiment in the construction of a touch data formation circuit 330 and a key return signal detection circuit 170.

The touch data formation circuit 330 includes the second counter 131, the flip-flop 133 connected to the first comparator 116, a latch 332 provided with a clear terminal CLR, a selector 333 connected to the output side of the latch 332, a preset value setter 334, a coincidence detection circuit 335 having an A terminal connected to the counter 131 and a B terminal connected to the setter 334, a flip-flop 336 having an S terminal connected to the coincidence detection circuit 335 and an R terminal connected to the key return signal detection circuit 170, two D-type flip-flops 337 and 338 connected in series and an AND-gate 339 leading to the L terminal of the latch 332.

The key return signal detection circuit 170 has a function to issue a return pulse before complete return of a key on the basis of a signal issued by a proximity sensor NS which is given in the form of the coil 54*a* in FIGS. 25 and 28 or the coil 57 in FIG. 29 and like. This circuit 170 includes a D-type flip-flop 171 connected to the proximity sensor, a NOT-gate 172 and an AND-gate 173 provided on the output side of the flip-flop 171.

As the proximity sensor NS issues a pulse signal "a" such as shown in FIG. 54 during key depression, the flip-flop 171 issues a pulse signal "b" in FIG. 54 with a time lag corresponding to one clock pulse CKO. The NOT-gate 172 issues a pulse signal "c" in FIG. 54 after inversion of the pulse signal "a" and the AND-gate issues a key return pulse signal "d" such as shown in FIG. 54 on receipt of the pulse signals "b" and "c". The system is designed so that this key return pulse signal "d" should be issued at a position II of the key K in FIG. 55 between the uppermost position I and the lowermost position III. As illustrated, this position II is located just before the uppermost position I. This key return pulse signal "d" is passed to the flip-flop 336 as a reset signal and to the latch 332 as well as the flip-flop 337 and 338 as clear signals.

Before key depression, the flip-flop 336 is kept reset and the latch 332 as well as the flip-flops 337 and 338 are kept cleared due to receipt of the key return pulse signal "d" issued in the foregoing cycle. A small value such as a value between 2 and 4 is chosen for the preset value at the setter 334.

As key depression is initiated, key operation pulses CK1 are issued by the key operation pulse detection circuit 100' at a pulse interval inversely proportional to the key depression speed. When the key depression speed exceeds a prescribed value, the output signal from the comparator 116 of the key detection circuit 110 becomes level "1" to set the flip-flop 133 and cancel the reset condition of the counter 131. The counter 131 continues to count subsequent key operation pulses CK1 and, when its count value reaches the preset value P3, A and B terminal input signals becomes equal at the coincidence detection circuit 335 which thereupon issues an output signal at level "1" to set the flip-flop 336. Input signals to the flip-flops 337 and 338 then become level "1".

When key operation pulses CK1 are generated due to accidental key vibration or unexpected finger touch on a key, a resultant small count value is not latched in accordance with this embodiment of the parameter changing means. This can be also said to a case when the key operation pulses CK1 are counted partly before the key depression speed reaches the preset value. Thus, this circuit well avoids the trouble of incorrect issue of the initial touch data which is otherwise caused by unintended generation of the key operation pulses CK1.

Counting of the key operation pulses CK1 is continued by the counter 131. As the key arrives at its lowermost position III, stop of the key movement makes the comparator 122 issue an output signal at level "1", the AND-gate 339 issue a latch signal at level "1" and the latch 332 latch the instant count value from the counter 131. Input of the pulses to the CK terminals of the flip-flop 337 and 338 makes the flip-flop 337 issue an output signal at level "1" and the selector 333 be enabled.

Under this condition, the selector 333 accepts the count value latched by the latch 332 to issue as the initial touch data to be passed to the multiplicating circuit 140 shown in FIG. 46. Concurrently, the flip-flop 133 is reset to issue an output signal at level "1" at its reversed Q terminal to disenable the counter 131.

As the key starts to ascend from its lowermost positon III, the key operation pulses CK1 are again generated to be detected by the key detection circuit 110. Then the counter 131 is released from its reset condition to restart counting of the key operation pulses CK1.

When the key stops before reaching the midway position II, the pulse signal from the key termination detection circuit 120 makes the latch 332 latch the instant count value from the counter 131. An output signal at level "1" appears at the D terminal of the flip-flop 338. On receipt of a pulse signal at its CK terminal, the flip-flop 338 issues an output signal at level "1" at its terminal Q to give a switch signal to the selector 333. Thereupon, the selector 333 accepts the count value latched at the latch 332 to issue after touch data to the multiplicating circuit in FIG. 46.

Every time the key thereafter moves in an area between the positions II and III, the counter 131 counts the key operation pulses CK1 and its count values are latched by the latch 332 to make the selector 333 issue after touch data.

On return to the key to above the midway position II, the key return signal detection circuit 170 issues the key return pulse "d" to clear the latch 332 as well as the flip-flop 337 and 338 and the selector 333 is made disabled. As a consequence, the count values from the counter 131 are not issued as the after touch data. When the key returns directly to its uppermost position I right after full depression, only the initial touch data are is issued with no issue of the after touch data.

Such a circuit is provided one for each musical tone controller, i.e. each key and the initial touch and after touch data issued from each touch data formation circuit 330 are passed to the multiplicating circuit 140 which transfers the same to the musical tone generating circuit 150 in a time division mode. The initial touch data controls various musical tone control parameters such as tone volume in multi-stage fashion whereas the after touch data also controls various musical tone control parameters such as delay vibrato, tremolo, change in pitch, change in tone colour and sustain wave shape. These two touch data can be detected by a single common circuit.

We claim:

1. A touch-response type tone controlling unit for an electronic musical instrument comprising:

a mobile controller which is adapted for movement upon manual operation by a player;

pulse generating means for generating pulses, the number of which corresponds to the extent of said movement of said mobile controller, and providing said pulses on one or more output lines, the number of output lines for said pulses being smaller than said number of said pulses;

counting means for counting said pulses; and parameter controlling means for controlling musical tone parameters on the basis of the number of pulses counted by said counting means.

2. An electronic musical instrument as claimed in claim 1, in which said musical tone parameter is tone volume, tone colour, tone pitch or effect.

3. An electronic musical instrument as claimed in claim 1, in which said pulse generating means includes magnetic means for generating said pulses in a magnetic manner.

4. An electronic musical instrument as claimed in claim 3, in which said magnetic means includes means for inducing magnetic change and means for detecting said magnetic change.

5. An electronic musical instrument as claimed in claim 4, in which said magnetic change inducing means includes a laminated magnet, a yoke facing said laminated magnet and a coil arranged around said yoke to issue pulse outputs, and said laminated magnet, yoke and coil are arranged to form a close magnetic circuit when said mobile controller is operated.

6. An electronic musical instrument as claimed in claim 5, in which said magnetic change inducing means includes a magnet pattern formed on said mobile controller, and said magnetic change detecting means includes a resin block provided with interstices each idly receptive of said magnet pattern on said mobile controller and a conductive pattern formed on a wall defining each said interstice.

7. An electronic musical instrument as claimed in claim 6 in which said conductive pattern is continuously folded in a hairpin mode at sections extending normal to the moving direction of said magnet pattern.

8. An electronic musical instrument as claimed in claim 7 in which the pitch of said conductive pattern is phased in the central section over ½ of the pitch of said magnet pattern.

9. An electronic musical instrument as claimed in claim 6 in which the pitch of said magnet pattern is phased in the central section over ½ of the pitch of said conductive pattern.

10. An electronic musical instrument as claimed in claim 1, wherein said pulse generating means includes photoelectric means for generating said pulses.

11. An electronic musical instrument as claimed in claim 10, in which said photoelectric means includes means for inducing optical change and means for detecting said optical change.

12. An electronic musical instrument as claimed in claim 11 in which said optical change inducing means includes a stripe pattern plate and said optical change detecting means includes a penetrating type photosensor arranged facing said stripe pattern plate.

13. An electronic musical instrument as claimed in claim 11, in which said optical change inducing means includes a horizontal stripe pattern plate and said optical change detecting means includes a reflecting type photosensor arranged facing said stripe pattern plate.

14. An electronic musical instrument as claimed in claim 13 in which said reflecting type photosensor includes a light emitter, a light collector and at least one reflecting plane, and the optical axes of said emitter and collector cross at said reflecting plane.

15. An electronic musical instrument as claimed in claim 12 or 13 in which said stripe pattern plate includes a pair of juxtaposed stripe units each accompanied with a photosensor unit, and said stripe units are phased from each other by ½ of the stripe pitch.

16. An electronic musical instrument as claimed in claim 12 or 13 in which said stripe pattern plate includes a pair of juxtaposed stripe units each accompanied with a photosensor unit, and said photosensor units are phased from each other by ½ of the pitch.

17. A touch-response type tone controlling unit for an electronic musical instrument comprising:

a key which is adapted for movement upon manual operation by a player;

pulse generating means for generating pulses, the number of which corresponds to the extent of said movement of said key, and providing said pulses on one or more output lines, the number of output lines for said pulses being smaller than said number of pulses;

counting means for counting said pulses; and parameter controlling means for controlling musical tone parameters on the basis of the number of pulses counted by said counting means.

18. An electronic musical instrument as claimed in claim 17, further comprising extending means for extending the stroke of said key.

19. An electronic musical instrument as claimed in claim 18, in which said pulse generating means includes magnetic means for generating said pulses in a magnetic manner.

20. An electronic musical instrument as claimed in claim 19, in which said magnetic means includes means for inducing magnetic change and means for detecting said magnetic change.

21. An electronic musical instrument as claimed in claim 20, in which said magnetic change inducing means includes a magnet pattern, and said magnetic change detecting means includes a resin block provided with interstices each receptive of said magnet pattern on said hammer and a conductive pattern formed on a wall defining each said interstice.

22. An electronic musical instrument as claimed in claim 21 in which said conductive pattern is continuously folded in a hairpin mode at sections extending normal to the moving direction of said magnet pattern.

23. An electronic musical instrument as claimed in claim 21 in which the pitch of said conductive pattern is phased in the central section over ½ of the pitch of said magnet pattern.

24. An electronic musical instrument as claimed in claim 21 in which the pitch of said magnet pattern is phased in the central section over ½ of the pitch of said conductive pattern.

25. An electronic musical instrument as claimed in claim 18, in which said pulse generating means includes photoelectric means for generating said pulses in a photoelectric manner.

26. An electronic musical instrument as claimed in claim 18, in which said extending means includes a hammer for providing a piano feeling.

27. An electronic musical instrument as claimed in claim 17, in which said parameter controlling means includes a key operation pulse detection circuit electrically connected to said pulse generating means for carying out wave shaping of said pulse signals, a keying detection circuit connected to the output side of said key operation pulse detection circuit, a touch data formation circuit connected to the output side of said key operation pulse detection circuit and said keying detection circuit, and a key termination detection circuit interposed between said keying detection circuit and touch data formation circuit.

28. An electronic musical instrument as claimed in claim 27 in which said key operation pulse detection circuit includes an ampilfier for amplifying and converting a pulse signal received form said detecting means in current from to an output pulse signal in voltage form, and a wave shaper shaping said output pulse signal from said amplifier via differentiation to issue a key operation pulse.

29. An electronic musical instrument as claimed in claim 28, in which said wave shaper contains a threshold level so that no key operation pulses are provided during return from operation of said key.

30. An electronic musical instrument as claimed in claim 28 in which said keying detection circuit includes an oscillator, a first counter for counting clock pulses issued by said oscillator, a first preset value setter for setting a first preset value, and a first comparator adapted to received said first preset value and count values from said first counter to issue a keying signal of lever "1" when said first preset value is larger than each said count value.

31. An electronic musical instrument as claimed in claim 30 in which said key termination detection circuit includes a second preset value setter for setting a second preset value, and a second comparator adapted to receive said second preset value and count values from said first counter to issue a key termination detection signal of level "1" when said second preset value is smaller than each said count value.

32. An electronic musical instrument as claimed in claim 31 in which said first and second preset values are close to the maximum count value of said first counter.

33. An electronic musical instrument as claimed in claim 30 or 31 in which said first preset value is smaller than the maximum count value of said first counter.

34. An electronic musical instrument as claimed in claim 31, in which said touch data formation circuit includes a second counter for counting said key operation pulses from said first comparator and providing an output to a sound system.

35. An electronic musical instrument as claimed in claim 34 in which said touch data formation circuit further includes a latch connected to the output side of said second counter, and a one-shot multi-vibrator interposed between said first comparator of said keying detection circuit and said latch.

36. An electronic musical instrument as claimed in claim 34 in which said touch data formation circuit provides N sets of separate touch data each corresponding to one of N divided time sections of one operation time of said musical tone controller, and wherein said touch data formation circuit comprises:

N sets of latches connected to the output side of said second counter in parallel to each other, each issuing one set of said touch data, N sets of one-shot multi-vibrators each connected to the input side of one side latch, and means for inhibiting provision of said touch data by each of said latches.

37. An electronic musical instrument as claimed in claim 36 in which said inhibiting means includes (N−1) sets of reducers connected to the output sides of an Mth latch and (M−1)th of said N sets of latches, M being a positive integer not exceeding N, (N−1) sets of comparators arranged on the output sides of said reducers, and a plurality of AND-gates connected to the output sides of said reducers and comparators.

38. An electronic musical instrument as claimed in claim 36 in which said touch data formation circuit further includes a latch having an input terminal connected to said second counter and a clear terminal;

a key return signal detection circuit connected to said clear terminal which issues a key return signal before complete return of said musical tone controller to its initial unoperated position, and a selector connected to said latch for selectively generating touch data and after touch data depending on the direction of movement of said controller.

39. An electronic musical instrument as claimed in claim 38 in which said key return signal detection circuit further includes a proximity sensor arranged facing said controller.

40. A touch-response type tone controlling unit for an electronic musical instrument comprising:

a push button adapted for movement upon manual operation by a player;

pulse generating means for generating pulses, the number of which corresponds to the extent of said movement of said push button, and providing said pulses on a plurality of output lines, the number of output lines for said pulses being smaller than said number of said pulses;

counting means for counting said pulses; and parameter controlling means for controlling musical tone parameters on the basis of the number of pulses counted by said counting means.

41. An electronic musical instrument as claimed in claim 40, further comprising:

means for detecting velocity or acceleration of the motion of said push button throughout the stroke thereof, and wherein said pulses correspond to a result of detection by said detecting means.

42. An electronic musical instrument as claimed in claim 41 in which said detecting means generates pulses corresponding to movement of said push button in said stroke on output lines whose number is smaller than that of said pulses.

43. An electronic musical instrument as claimed in claim 40, in which said pulse generating means includes magnetic means for generating said pulses in a magnetic manner.

44. An electronic musical instrument as claimed in claim 43, in which said magnetic means includes means for inducing magnetic change and means for detecting said magnetic change.

45. An electronic musical instrument as claimed in claim 44 in which said magnetic change inducing means includes a laminated magnet, and said magnetic change detecting means includes a coil through which said laminated magnet passes.

46. An electronic musical instrument as claimed in claim 44 in which said magnetic change inducing means includes a pair of magnet plates attached to the bottom of each said push button, and said magnetic change detecting means includes a pair of coils attached to both faces of a print board surrounding a slit for passage of said push button.

47. A touch-response type tone controlling unit for an electronic musical instrument comprising:

a pedal button adapted for movement upon manual operation by a player;

pulse generating means for generating pulses, the number of which corresponds to the extent of said movement of said pedal, and providing said pulses on one or more output lines, the number of output lines for said pulses being smaller than said number of said pulses;

counting means for counting said pulses; and parameter controlling means for controlling musical tone parameters on the basis of the number of pulses counted by said counting means.

48. An electronic musical instrument as claimed in claim 47, in which said pedal button includes a button and a pedal pivotally mounted to said button, and said pulse generating means includes means for inducing optical change caused by movement of said pedal and means for detecting said optical change.

49. An electronic musical instrument as claimed in claim 48, in which said optical change inducing means includes a fixed stripe pattern arranged on said button, a mobile stripe pattern and means for operationally coupling said pedal to said mobile stripe pattern so that operation on said pedal causes overlapping between said fixed and mobile patterns.

50. An electronic musical instrument as claimed in claim 49 in which said coupling means includes a pinion-rack combination.

51. An electronic musical instrument as claimed in claim 49 in which said fixed and mobile stripe patterns have the same stripe pitch and an angle of mutual inclination which produces a moire stripe pattern upon the overlapping of said stripe patterns.

52. An electronic musical instrument as claimed in claim 49 in which said optical change detecting means includes a penetrating type photosensor having light emitting and collecting elements arranged on different sides of said fixed and mobile strip patterns.

53. An electronic musical instrument as claimed in 49 in which said optical change detecting means includes a reflecting type photosensor having light emitting and collecting elements arranged on a same side of said fixed and mobile stripe patterns.

54. A detecting apparatus for detection of movement for control of an electronic musical instrument, comprising:

a first plate having first dark stripes attached to a first object, a second plate having second dark stripes and clear stripes alternately attached to a second object.

means for overlapping said first plate with said second plate with a small inclination between said first and second dark stripes, whereby moire stripes appear on an overlapped position of said first and second plates on the basis of the moire principle and said moire stripes are larger than said first and second dark stripes, and means for detecting said moire stripes for detection of movements of said first and second objects or an angle between said first and second objects.

55. A detecting apparatus as claimed in claim 54 in which said first and second dark stripes are formed along an imaginary cylindrical plane so that said angle between said first and second object or said little inclination are changed.

56. A detecting apparatus as claimed in claim 54 in which said detecting means generates pulses corresponding to the result of detection of said moire stripes on the output lines whose number is smaller than that of said pulses.

57. A detecting apparatus as claimed in claim 56 in which said moire stripe detecting means includes a penetrating type photosensor made up of light emitting and collecting elements arranged on different sides of said first and second pattern plates.

58. A detecting apparatus as claimed in claim 57 in which the angle of said little inclination is chosen so that the interval of a resultant moire stripe is larger than the degree of resolution of said photosensor.

59. An electronic musical instrument as claimed in claim 56 in which said moire stripe detecting means includes a reflecting type photosensor made up of light emitting and collecting elements arranged on the same side of said first and second pattern plates.

* * * * *